US006717286B2

(12) United States Patent
Tsuchiya et al.

(10) Patent No.: US 6,717,286 B2
(45) Date of Patent: Apr. 6, 2004

(54) PASTING AND BOOKBINDING METHOD, PASTING AND BOOKBINDING APPARATUS, AND IMAGE FORMING APPARATUS FOR USE THEREWITH

(75) Inventors: Tsuyoshi Tsuchiya, Hachioji (JP); Toshio Shida, Hachioji (JP); Mikihiro Yamakawa, Hachioji (JP); Katsunori Takahashi, Hachioji (JP); Toshitaka Matsumoto, Tokyo (JP); Takenobu Kimura, Hachioji (JP)

(73) Assignee: Konica Corporation (JP)

( * ) Notice: Subject to any disclaimer, the term of this patent is extended or adjusted under 35 U.S.C. 154(b) by 143 days.

(21) Appl. No.: 10/038,841

(22) Filed: Dec. 31, 2001

(65) Prior Publication Data

US 2002/0089111 A1 Jul. 11, 2002

(30) Foreign Application Priority Data

Jan. 9, 2001 (JP) ..... 2001-001265
Mar. 26, 2001 (JP) ..... 2001-087326
Mar. 27, 2001 (JP) ..... 2001-090008

(51) Int. Cl.[7] ..... B42C 9/00

(52) U.S. Cl. ..... 290/58.07; 270/52.18; 399/408; 412/8; 412/19; 412/37; 412/902

(58) Field of Search ..... 270/58.07, 58.08, 270/52.18; 399/408; 412/4, 8, 18, 19, 20, 24, 37, 902; 118/46, 236; 156/908

(56) References Cited

U.S. PATENT DOCUMENTS 4,473,425 A * 9/1984 Baughman et al. ..... 156/356
4,540,458 A * 9/1985 Baughman et al. ..... 156/312
4,611,741 A * 9/1986 Wilson ..... 227/99
4,640,611 A * 2/1987 Ohdake et al. ..... 355/77
5,140,380 A * 8/1992 Nakamura et al. ..... 399/408
5,213,317 A * 5/1993 Mandel et al. ..... 270/58.11
5,854,957 A * 12/1998 Morikawa ..... 399/38
5,881,352 A * 3/1999 Kobayashi et al. ..... 399/408
5,931,624 A * 8/1999 Naruse ..... 412/8
6,199,851 B1 * 3/2001 Latvakangas et al. .... 270/58.08
6,530,339 B1 * 3/2003 Silverbrook ..... 118/46
6,592,056 B2 * 7/2003 Yamakawa et al. ..... 239/569

FOREIGN PATENT DOCUMENTS

JP 2001328764 A * 11/2001 ..... B65H/37/02
JP 2001334771 A * 12/2001 ..... B42C/9/00
JP 2001341461 A * 12/2001 ..... B42C/9/00
JP 2002036747 A * 2/2002 ..... B42C/9/00
JP 2002200862 A * 7/2002 ..... B42C/9/00

* cited by examiner

*Primary Examiner*—Patrick Mackey
(74) *Attorney, Agent, or Firm*—Muserlian, Lucas and Mercanti

(57) ABSTRACT

A pasting and bookbinding method in which a leading edge of a sheet conveyed in a first conveying path having a sheet conveyor is brought into contact with a hitting member and the sheet skew is corrected, a linear paste coating portion is formed by a paste jetting device in the vicinity of a side edge portion of the sheet conveyed in a second conveying path in a direction perpendicular to the first conveying path, and plural sheets after the paste coating processing are stacked on a sheet stacking table provided below the second conveying path, and aligned by an aligner, and the linear pasted portion is pressed by a pressing device, and after a pasted booklet is produced, the booklet is delivered onto the delivery tray provided in the conveying direction downstream of the first conveying path and on an outside side surface of the apparatus.

17 Claims, 39 Drawing Sheets

FIG. 15 ( a )
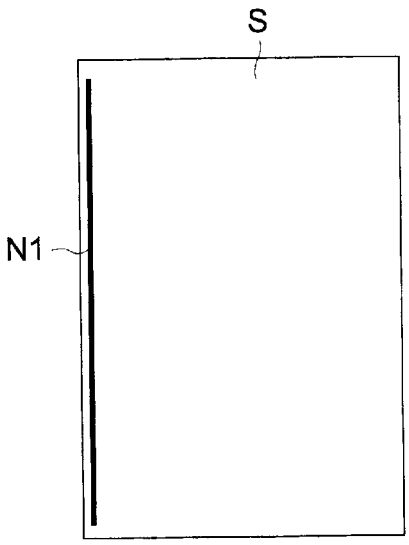
FIG. 15 ( b )
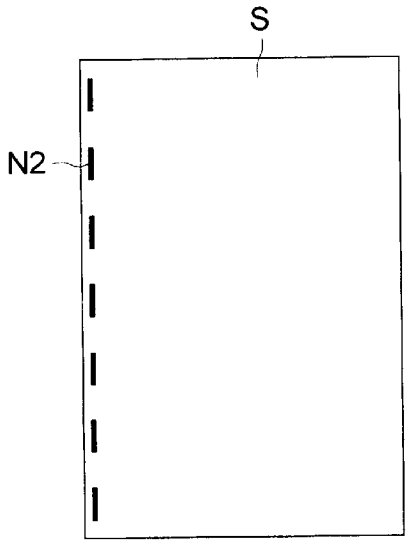
FIG. 15 ( c )
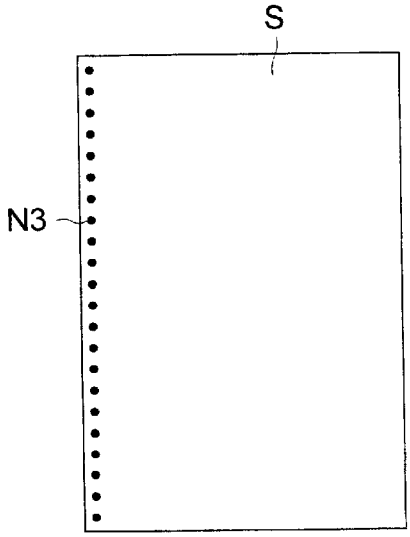
FIG. 15 ( d )
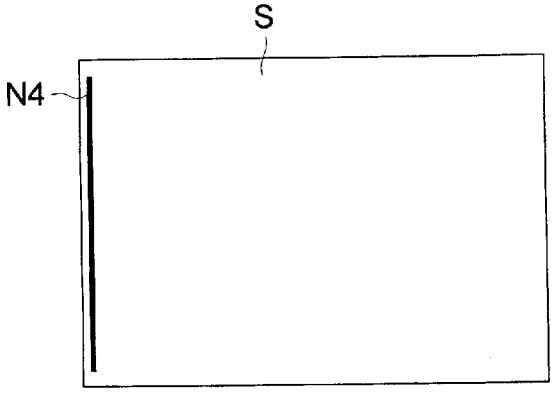

FIG. 16 ( a )
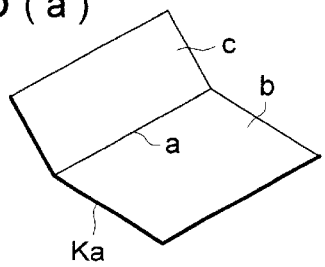
FIG. 16 ( b )
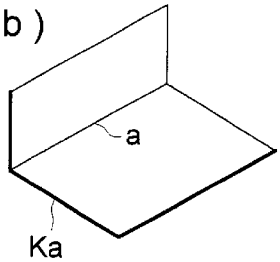
FIG. 16 ( c )
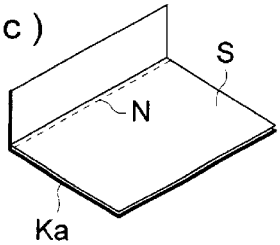
FIG. 16 ( d )
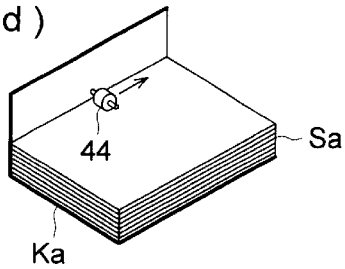
FIG. 16 ( e )
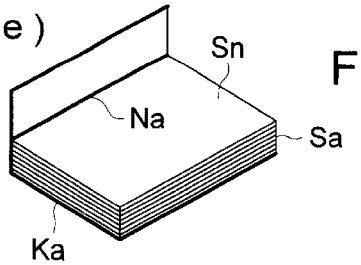
FIG. 16 ( f )
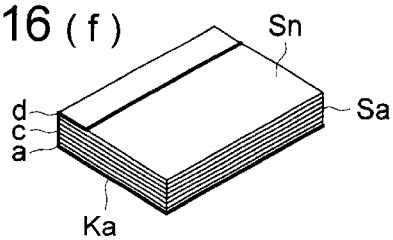
FIG. 16 ( g )
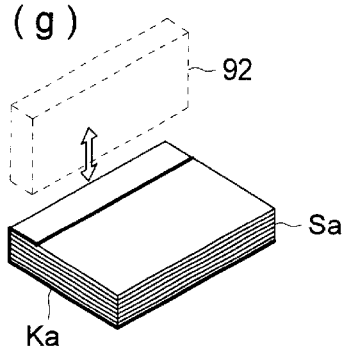
FIG. 16 ( h )
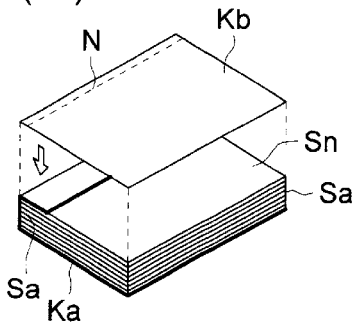
FIG. 16 ( i )
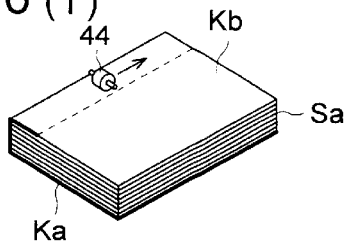
FIG. 16 ( j )
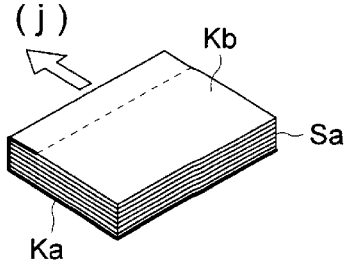

FIG. 17 ( a )
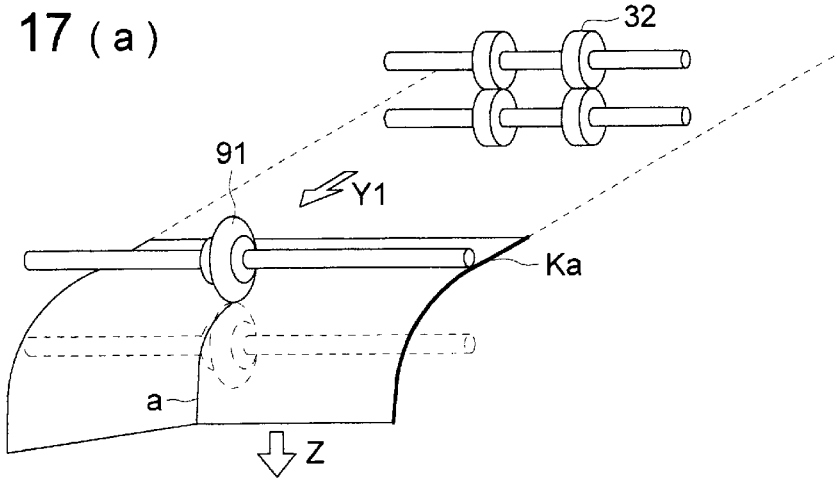
FIG. 17 ( b )
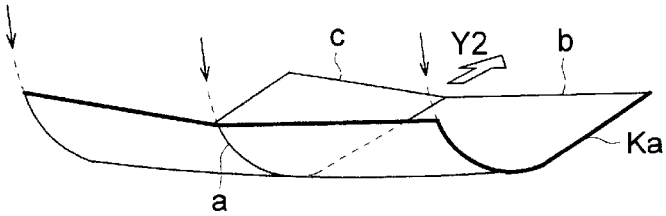
FIG. 17 ( c )
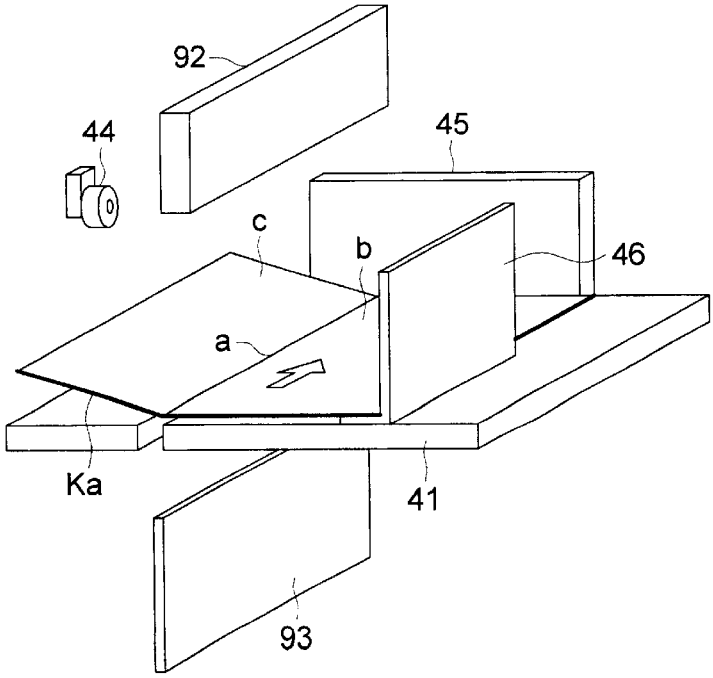

FIG. 18 ( a )
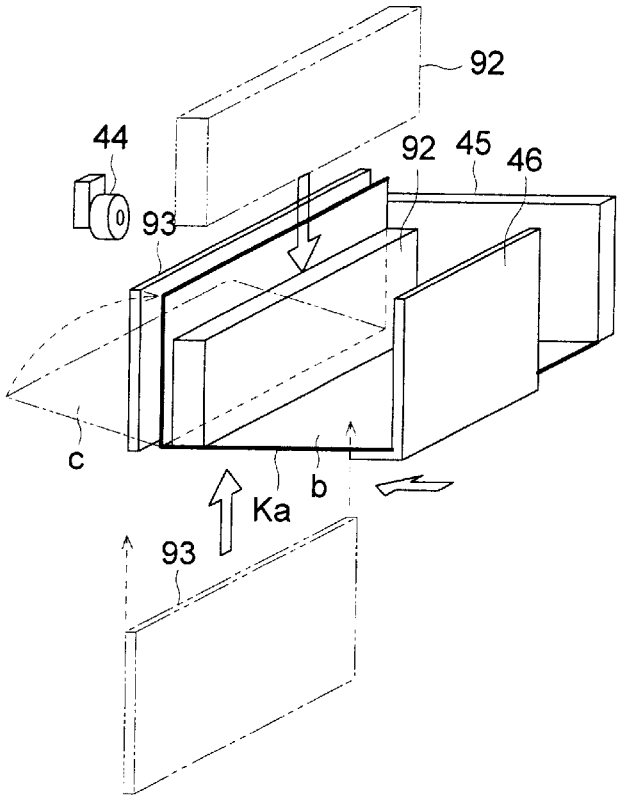
FIG. 18 ( b )
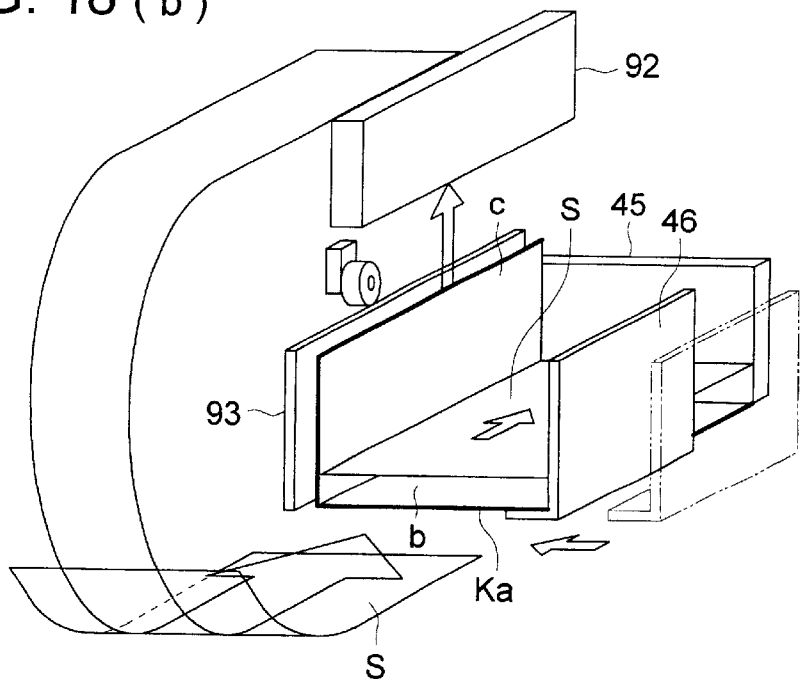

FIG. 19 ( a )
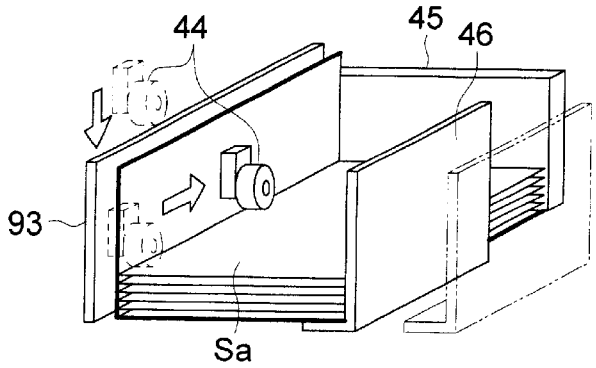
FIG. 19 ( b )
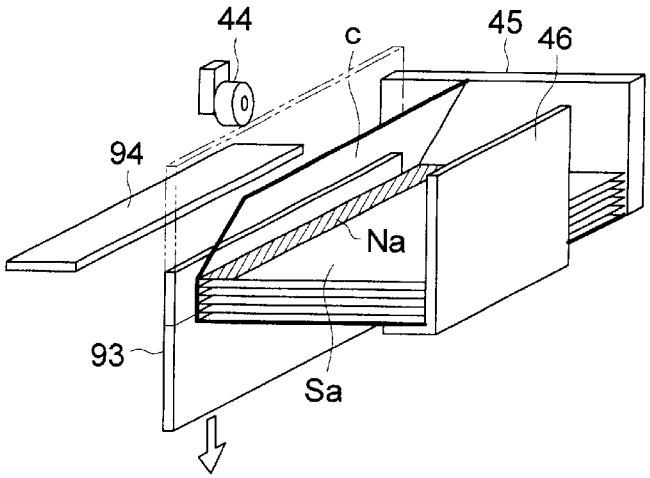
FIG. 19 ( c )
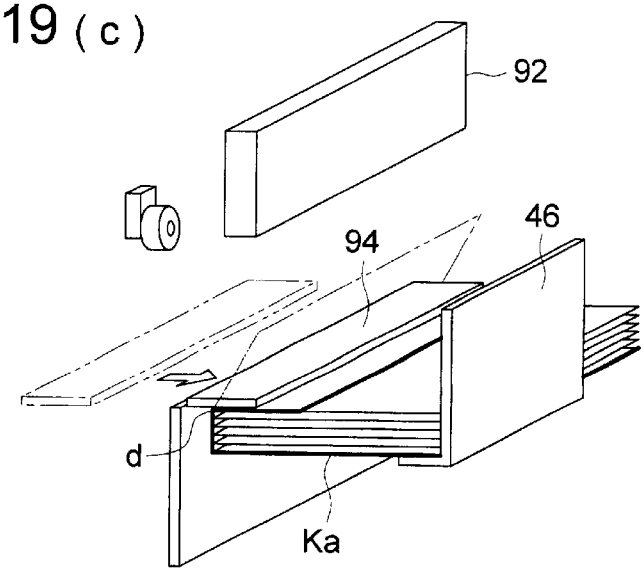

FIG. 20 ( a )
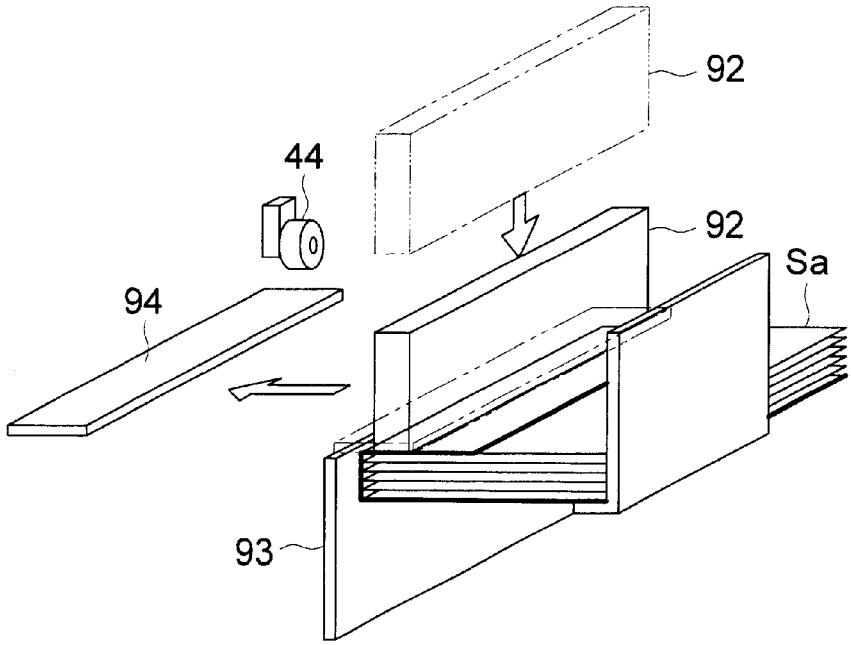
FIG. 20 ( b )
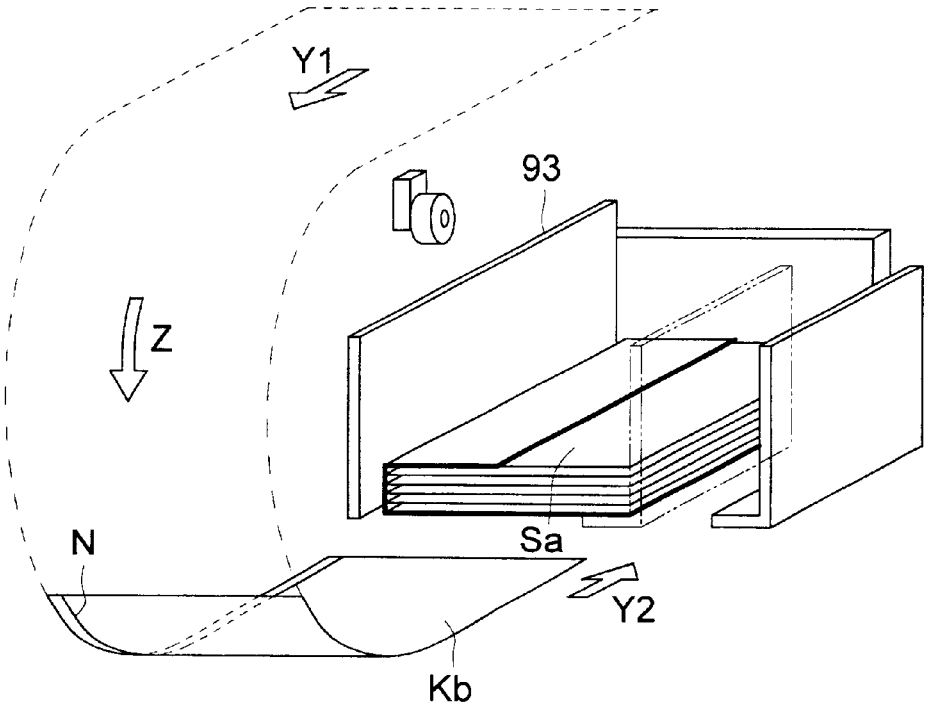

FIG. 23 ( a )
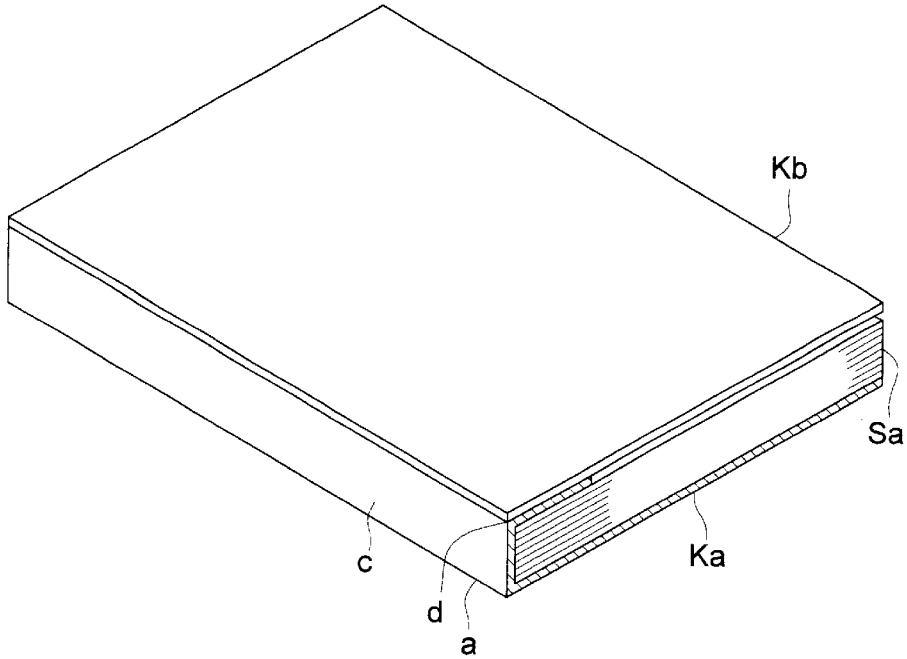
FIG. 23 ( b )
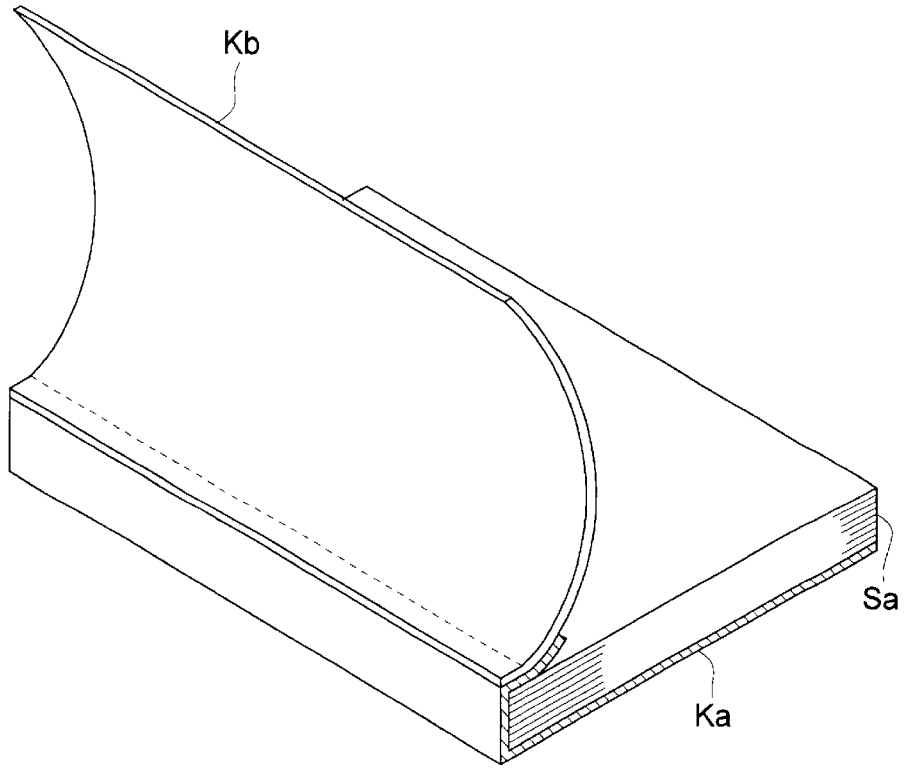

FIG. 32 ( a )
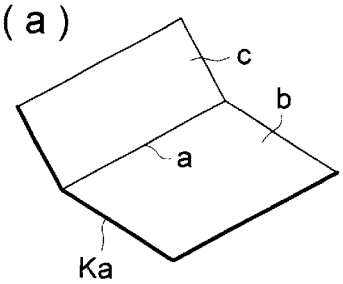
FIG. 32 ( b )
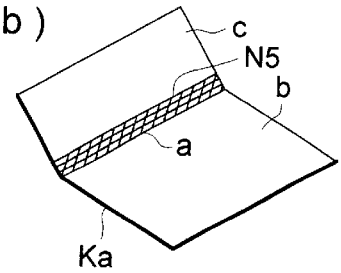
FIG. 32 ( c )
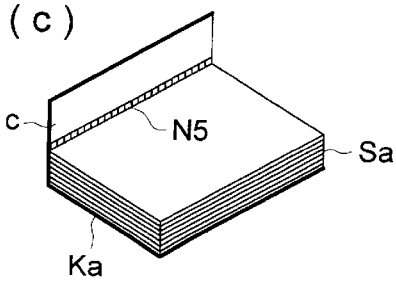
FIG. 32 ( d )
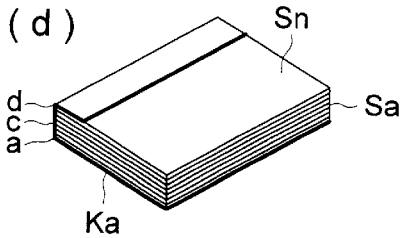
FIG. 32 ( e )
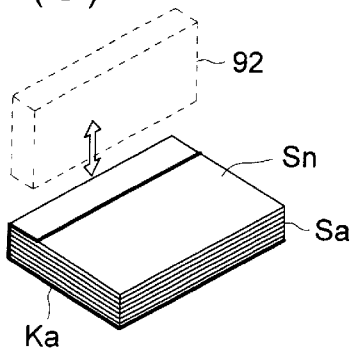
FIG. 32 ( f )
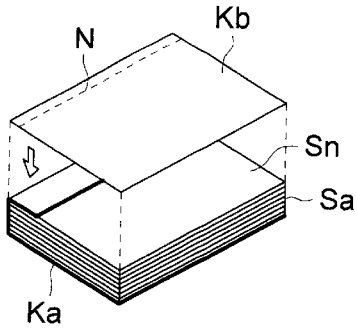
FIG. 32 ( g )
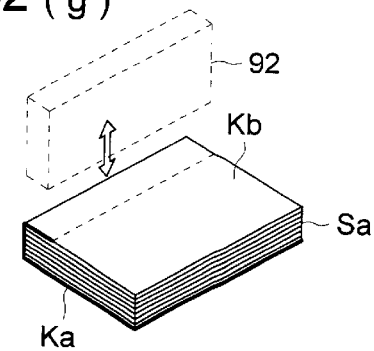
FIG. 32 ( h )
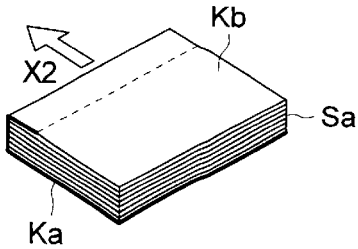

FIG. 34 ( a )
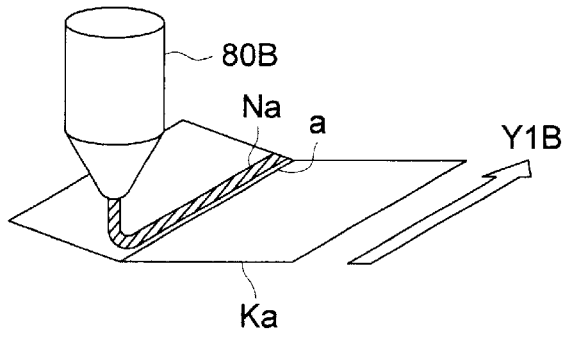
FIG. 34 ( b )
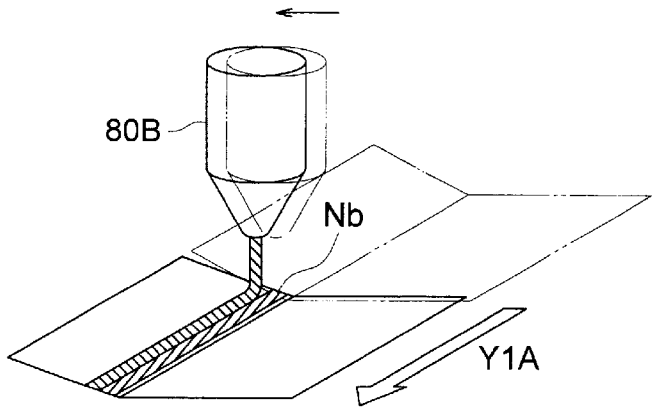
FIG. 34 ( c )
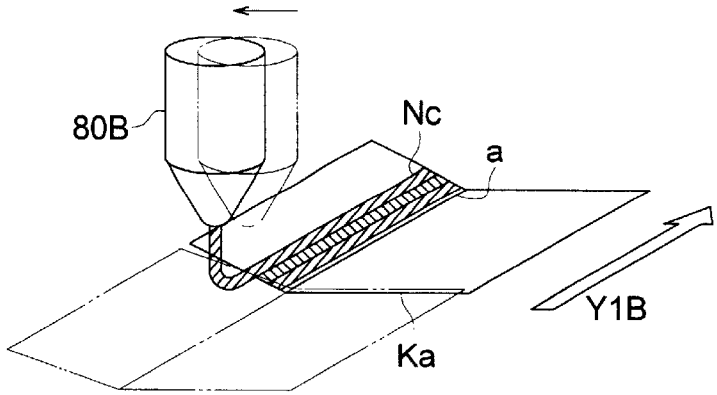

FIG. 36 ( a )
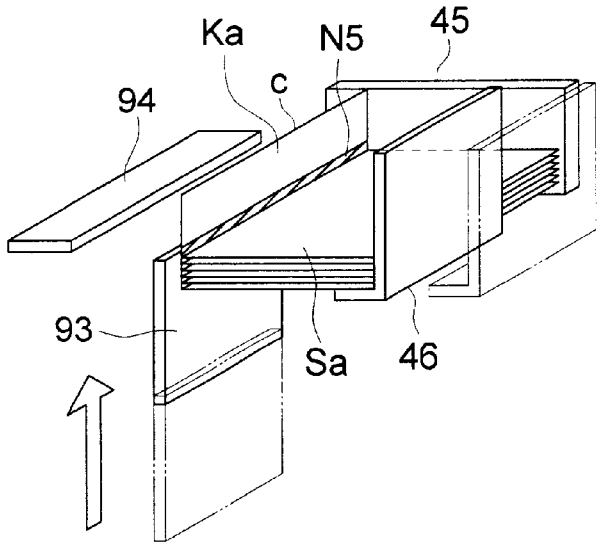
FIG. 36 ( b )
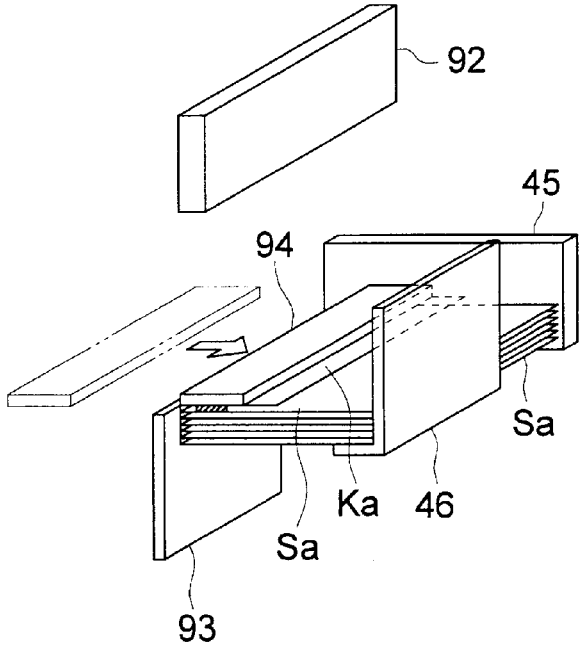

PASTING AND BOOKBINDING METHOD, PASTING AND BOOKBINDING APPARATUS, AND IMAGE FORMING APPARATUS FOR USE THEREWITH

BACKGROUND OF THE INVENTION

The present invention relates to a pasting and bookbinding method and a pasting and bookbinding apparatus by which the paste is linearly pasted in the vicinity of the sheet side edge to image formation processed sheets, and one side edge of the sheet set is covered by the book cover and a booklet is produced, and particularly to a pasting and bookbinding apparatus which is connected to an image forming apparatus such as a copier, facsimile device, or printer, or which can be applied for the image forming apparatus, and to an image forming apparatus provided with the pasting and bookbinding apparatus.

Generally, a sheet on which an image is recorded by a copier, facsimile device, printer and image forming apparatus main body which is a composite machine of them, is variously processed as a post-processing, by, for example, punching, stapling, central stapling and central folding, book covering, folding, stamping, or pasting and bookbinding.

As a pasting and bookbinding apparatus, the following apparatus are used.

(1) An apparatus to jet the paste onto the sheet by using a paste jetting nozzle, (2) an apparatus in which a paste wheel is provided to the paste container, and the paste is fitted onto the outer periphery of the rotating paste wheel, and the outer periphery of the paste wheel is brought into contact with the sheet and the contact transfer is conducted, (3) a hot melt coating apparatus to jet a mixed body of a hot melt agent (thermal fusion agent) and a heating compression air from the nozzle, or (4) a tape pasting apparatus to glue a tape onto which a paste having the adhesion property is previously pasted, onto one side edge of a sheet set while heating the tape.

A pasting method and apparatus disclosed in Japanese Tokkaihei-No. 7-80377, is a method and apparatus in which a high pressure air is blown upon the paste jetted from the paste jetting nozzle and the paste is formed into a thin film-like one.

A bookbinding apparatus disclosed in Japanese Tokkaisho-No. 59-500907 (corresponding to U.S. Pat. No. 4,473,425) is an apparatus in which the sheet conveyed in the first direction is deflected to the second conveyance direction perpendicular to the first conveyance direction, and after that, the paste is linearly pasted on the end portion of the running sheet, and after the sheets are stacked and aligned, the sheets are pressed, aligned and book-bound.

As a back side taping bookbinding method, methods in which a tape on which the paste having the adhesion property at the time of heating is previously pasted, is pasted while being heated, or a tape on which the paste having the adhesion property when the water is included, is previously pasted, is used, are well known. The conventional tape pasting method is disclosed in Japanese Tokkaisho No. 62-284795, U.S. Pat. No. 4,985,729, Japanese Tokkaihei No. 3-151286, or No. 6-115275.

In the conventional pasting and bookbinding apparatus, there are following problems.

(1) In the back side tape pasting system, after the tape is pasted onto the backbone of sheet set, because the tape is folded to the front book cover side and the back book cover side, when the system is made so that the tape can be highly reliably pasted corresponding to the kind of sheets, or the thickness of sheet set, the structure of the apparatus becomes complicated and large sized.

(2) In a system in which the sheet set is covered by a book cover which is integrated with the front book cover and the back book cover, and the back surface of the sheet set is adhered, the book cover length corresponding to the maximum thickness of the sheet set is necessary, and after the book cover is adhered by using a special large sized book cover, a process by which the excessive book cover portion protruded from the sheet set is cut and removed, is necessary.

(3) In a pasting and bookbinding apparatus by which the sheet set, front book cover, and back book cover are aligned at high speed and accurately, and the high quality bookbinding is conducted, the structure of the apparatus becomes complicated and large sized.

(4) For pasting and bookbinding the sheet delivered at a high speed from the image forming apparatus main body, in order to maintain the high speed productivity, the structure of the apparatus becomes complicated and large sized.

(5) It is difficult that the booklet which is made by thermally adhered by the hot melt coating apparatus is recycled as the regenerated paper.

(6) When a sheet set production mechanism by which the pasting processed sheet is conveyed, stacked, and the pasted portion between sheets is pressed and the sheet set is formed, and the cover bookbinding production mechanism by which the book cover surface side of the sheet set and the back book cover surface and the back portion are covered by the book cover and adhered, are accommodated in integrated pasting and bookbinding apparatus, the waiting time for the pasting and bookbinding process is generated, and the productivity for bookbinding producing is lowered.

SUMMARY OF THE INVENTION

The first object of the present invention is to provide a pasting and bookbinding method, a pasting and bookbinding apparatus and an image forming apparatus to solve the above problems.

The second object of the present invention is to provide a pasting and bookbinding method by which the above problems are solved and the pasting and bookbinding apparatus is improved, and the formation of the sheet set and the alignment and adherence of the front book cover and back book cover are surely attained, and the deterioration of the finishing quality of the bookbinding is prevented, and the productivity at the high speed processing is maintained, a pasting and bookbinding apparatus, and an image forming apparatus provided with the pasting and bookbinding apparatus.

The first object is solved by one of the following structures of the present invention.

(1) A pasting and bookbinding method which is characterized by being structured such that: the leading edge portion of the sheet conveyed in the first conveying path having a sheet conveying means is brought into contact with a hitting member and the sheet skew is corrected; a linear paste coating portion is formed by a paste jetting means in the vicinity of the side edge portion of the sheet conveyed in the second conveying path on which the sheet is conveyed in the direction perpendicular to the first conveying path; and a plurality of sheets after paste coating processing are stacked on a sheet stacking table provided below the second conveying path, and aligned by an aligning means, and the linear pasted portion is pressed by a pressing means, and after a pasted booklet is produced, the booklet is delivered by a delivery means, and delivered onto the delivery tray provided in the conveying direction downstream of the first conveying path and on an outside side surface of the apparatus.

(2) A pasting and bookbinding apparatus which comprises: the first conveying path for positioning the sheet by correcting the sheet skew when the sheet conveyed from the outside is conveyed and the leading edge portion of the sheet is brought into contact with the contact member; the second conveying path to convey the sheet in the direction perpendicular to the first conveying path; a paste jetting means which is provided on the second conveying path and to form a paste coating portion in the vicinity of the side edge portion of the sheet; the third conveying path to reversed-convey the sheet after the paste coating processed; the fourth conveying path to stack the sheets onto the sheet stacking table provided below the second conveying path; an alignment means for aligning a plurality of sheets stacked onto sheet stacking table; a pressure means for pressing the pasted portion and producing the booklet; a delivery means for delivering the booklet; and a delivery tray which is provided on the conveying direction downstream of the first conveying path and an outside side surface of the apparatus, and which accommodates the delivered booklet.

(3) A pasting and bookbinding apparatus which comprises: the first conveying path to introduce and convey the sheet delivered from the image forming apparatus main body and to deliver from the first delivering port and stack onto the first delivery tray; and the second conveying path to branch and convey the introduced sheet from the first conveying path and form the pasted portion on the side edge portion of the sheet from a paste jetting means, and conduct the alignment processing of the sheets and pressing processing of the pasted portion, and deliver the produced booklet from the second delivery port and stack onto the second delivery tray.

(4) An image forming apparatus which comprises: an image forming apparatus main body composed of an image writing means, image forming means, and sheet conveying apparatus; and a pasting and bookbinding apparatus described in above (2) or (3) to conduct the paste coating processing on the sheet delivered from the image forming apparatus main body.

The above second object is solved by any one of the following methods and apparatus of the present invention.

(5) A pasting and bookbinding method in which the front book cover surface side and back book cover surface side and backbone portion of the sheet set are covered by the front book cover and back book cover and pasted, and the booklet is produced, wherein the front book cover has the dimension to cover the front book cover surface side and the backbone portion and a portion of the back book cover surface side, the back book cover has the same size as the sheet set, and a portion between adjacent sheets of the sheet set is adhered at the paste coating portion, and the side edge portion of the front book cover surface side and the side edge portion of the back book cover surface side and backbone portion of the sheet set are covered by the front book cover and adhered, and after the back book cover is adhered onto the front book cover, the pasted portion of the sheet set is pressed and the booklet is produced.

(6) A pasting and bookbinding apparatus which comprises: a sheet set production function to form a linear paste coating portion on the sheet surface by the paste jetting means during the conveyance of the sheet delivered from the image forming apparatus, convey and stack the pasted sheet onto the sheet stacking table, and press the pasted portion between adjacent sheets and form the sheet set; and a cover bookbinding production function to convey and align the book cover onto the sheet stacking table, to fold almost at right angle by the first creasing means, and after that, stack the pasted sheet by the sheet set production function onto the book cover successively, and further turn up the book cover by the second creasing means and cover the backbone portion of the sheet set and adhere it, and produce the booklet.

(7) The image forming apparatus of the present invention comprises: the image forming apparatus main body composed of the image writing means, image forming means, and sheet conveying means; and the pasting and bookbinding apparatus described in above (6).

(8) A pasting and bookbinding apparatus which comprises: a sheet set production apparatus to form a linear paste coating portion on the sheet surface by the paste jetting means during the conveyance of the sheet delivered from the image forming apparatus main body, convey and stack the paste coating processed sheet onto the sheet stacking table, and press the pasted portion between adjacent sheets and form the sheet set; and a cover bookbinding production apparatus which is connected to the sheet set production apparatus and which receives the sheet set formed by the sheet set production apparatus, and covers the side edge portion of the book cover surface side and the side edge portion of the back book cover surface side and the back portion of the sheet set by the paste coating processed book cover and adheres them.

(9) A pasting and bookbinding method in which the front book cover surface side and the back book cover surface side and the backbone portion of the sheet set is covered by the front book cover and the back book cover and pasted, and the booklet is produced, wherein the front book cover is fed by a front book cover feed means, and the paste coating portion is formed at a predetermined area of the front book cover by the paste jetting means, and after the front book cover is stacked at a predetermined position on the sheet stacking table by the conveying means, the sheet set formed by the sheet set production apparatus is conveyed onto the front book cover, and initially, the paste coating portion of the front book cover portion and front surface side of the sheet set are adhered, and next, the first fold is formed on the front book cover, and the backbone portion of the sheet set and the paste coating portion of the front book cover corresponding to the back portion are adhered, and further, the second fold is formed on the front book cover along the upper surface of the sheet set, and the upper surface side edge portion of the sheet set and the paste coating portion of the front book cover corresponding to the upper surface side edge portion are adhered, after that, a linear paste coating portion is formed by the paste jetting means on the back book cover fed by a back book cover feeding means, and after the sheets are conveyed onto the upper surface of the front book cover folded along the first fold by the conveying means and stacked and adhered, the pasted portions of the front book cover, sheet set, and back book cover are pressed and the pasting and bookbinding is produced.

(10) An image forming apparatus of the present invention comprises: an image forming apparatus main body composed of an image writing means, image forming means, and sheet conveying means; and a pasting and bookbinding apparatus described in above (8).

BRIEF DESCRIPTION OF THE DRAWINGS

FIGS. 15(*a*)–15(*d*) are plan views showing each kind of paste coating portions formed in the vicinity of a side edge portion of a sheet.

FIGS. 16(*a*)–16(*j*) are perspective views showing processes in which a front book cover and a back book cover are pasted onto the sheet set and the cover book binding is produced.

FIGS. 17(*a*)–17(*c*) are perspective views showing a detail of the pasting by the pasting and bookbinding apparatus and the cover bookbinding production process.

FIGS. 18(*a*)–18(*b*) are perspective views showing a detail of the pasting by the pasting and bookbinding apparatus and the cover bookbinding production process.

FIGS. 19(*a*)–19(*c*) are perspective views showing a detail of the pasting by the pasting and bookbinding apparatus and the cover bookbinding production process.

FIGS. 20(*a*)–20(*b*) are perspective views showing a detail of the pasting by the pasting and bookbinding apparatus and the cover bookbinding production process.

FIGS. 23(*a*) and 23(*b*) are a perspective view showing a completion of the cover bookbinding, and a perspective view showing the cover bookbinding in the condition that the back book cover is half opened.

FIGS. 32(*a*)–32(*h*) is perspective views showing a process to glue the front book cover and back book cover onto a sheet set and conduct the cover bookbinding.

FIGS. 34(*a*)–34(*c*) are perspective views showing a detail of pasting and cover bookbinding production process by a pasting and bookbinding apparatus.

FIGS. 36(*a*)–36(*b*) are perspective views showing a detail of pasting and cover bookbinding production process by a pasting and bookbinding apparatus.

DETAILED DESCRIPTION OF THE PREFERRED EMBODIMENT

Figure 1:
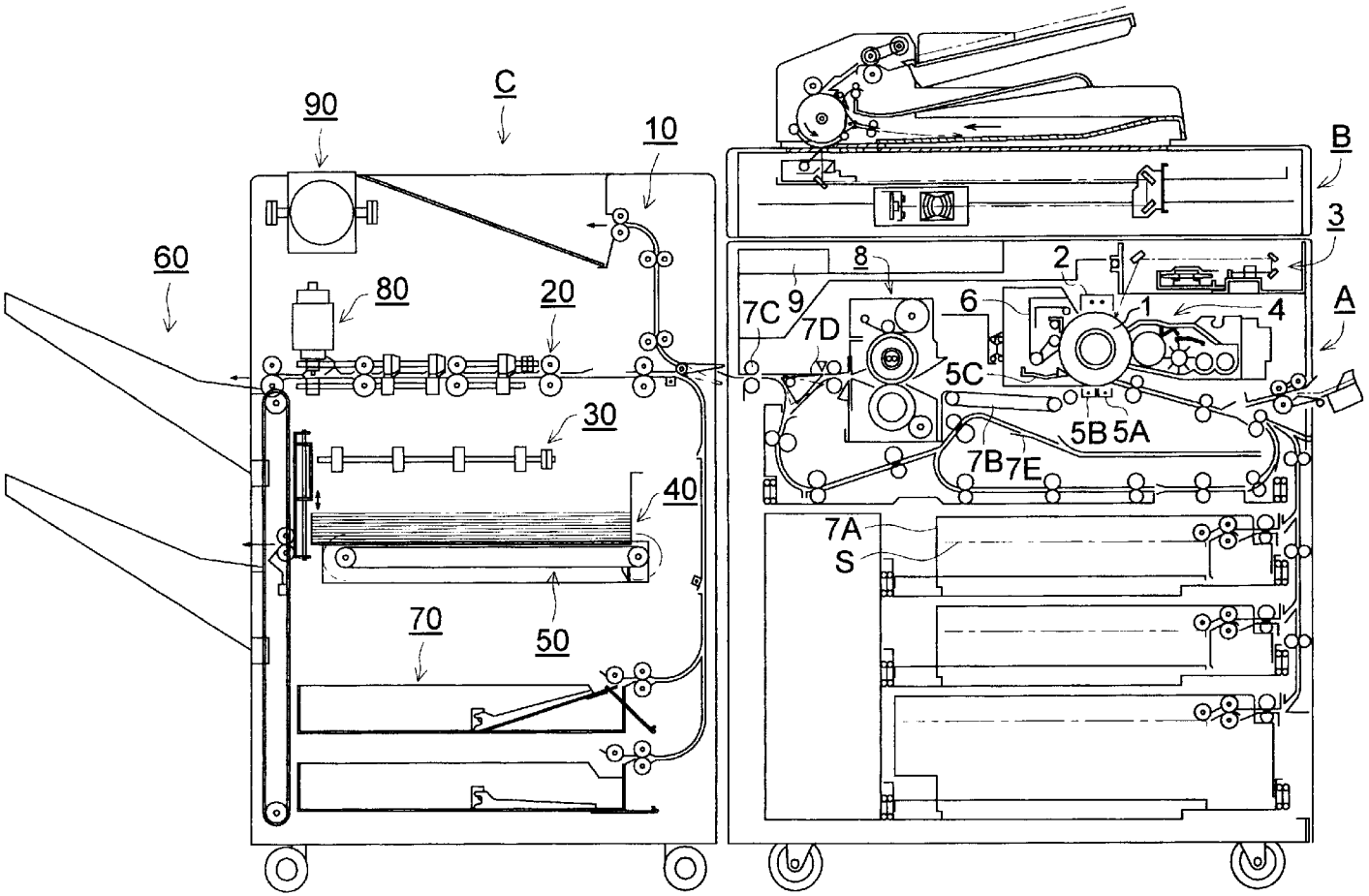
FIG. 1 is an overall structural view of an image forming system composed of an image forming apparatus main body, image reading apparatus, and pasting and bookbinding apparatus.

Next, referring to the drawings, a pasting and bookbinding method, pasting and bookbinding apparatus, and image forming apparatus provided with the pasting and bookbinding apparatus of the present invention will be described.

(An Embodiment of an Image Forming Apparatus)

FIG. 1 is an overall structural view of an image forming system composed of an image forming apparatus main body A, image reading apparatus B, and pasting and bookbinding apparatus C.

The image forming apparatus main body A arranges a charging means 2, image exposure means (writing means) 3, developing means 4, transfer means 5A, discharging means 5B, separation claw, and cleaning means 6 around a rotating image carrier (hereinafter, called photoreceptor) 1, and after the uniform charging is conducted on the surface of the photoreceptor 1 by the charging means 2, by conducting the laser beam scanning according to the image data red from a document by a laser beam of the image exposure means 3, a latent image is formed, and the latent image is reversal developed by the developing means 4, and the toner image is formed on the surface of the photoreceptor 1.

On the one hand, a transfer sheet (hereinafter, called sheet) S fed from a sheet accommodation means 7*a* is sent to the transfer position. At the transfer position, the toner image is transferred onto the sheet S by the transfer means 5A. After that, the electric charge of the rear surface of the sheet S is erased by the discharge means 5B, and the sheet S is separated from the photoreceptor 1 by the separation claw 5C, and conveyed by an intermediate conveying section 7B, and in succession, thermally fixed by a fixing means 8, and delivered by a delivery roller 7C.

When the image formation is conducted on both sides of the sheet S, the sheet S thermally fixed by the fixing means 8 is branched from the normal delivery sheet path by a conveying path switching plate 7D, and after it is switch backed on a reversal conveyance path and the front side and rear side are reversed, it is delivered to the apparatus outside by the delivery sheet roller 7C. The sheet S delivered by the delivery sheet roller 7C, is sent into a receiving section 11 of the pasting and bookbinding apparatus C.

On the one hand, on the surface after image processing of the photoreceptor 1, the developing agent remaining on the surface is removed by the cleaning means 6 at the downstream of the separation claw 5C, and the surface of the photoreceptor 1 stands by the next image formation.

An image reading apparatus B provided with an automatic document feeding apparatus of a document movement type reading system is arranged in the upper portion of the image forming apparatus main body A.

The pasting and bookbinding apparatus C is structured by: a sheet conveyance system composed of an uppermost stage direct sheet delivery means 10, horizontal conveying means 20 in its lower portion, direction change conveying means 30, stacking means 40, delivery means 50, sheet delivery means 60 and cover supply means 70; and a paste coating apparatus composed of a paste jetting means 80 and paste supply means 90.

Figure 2:
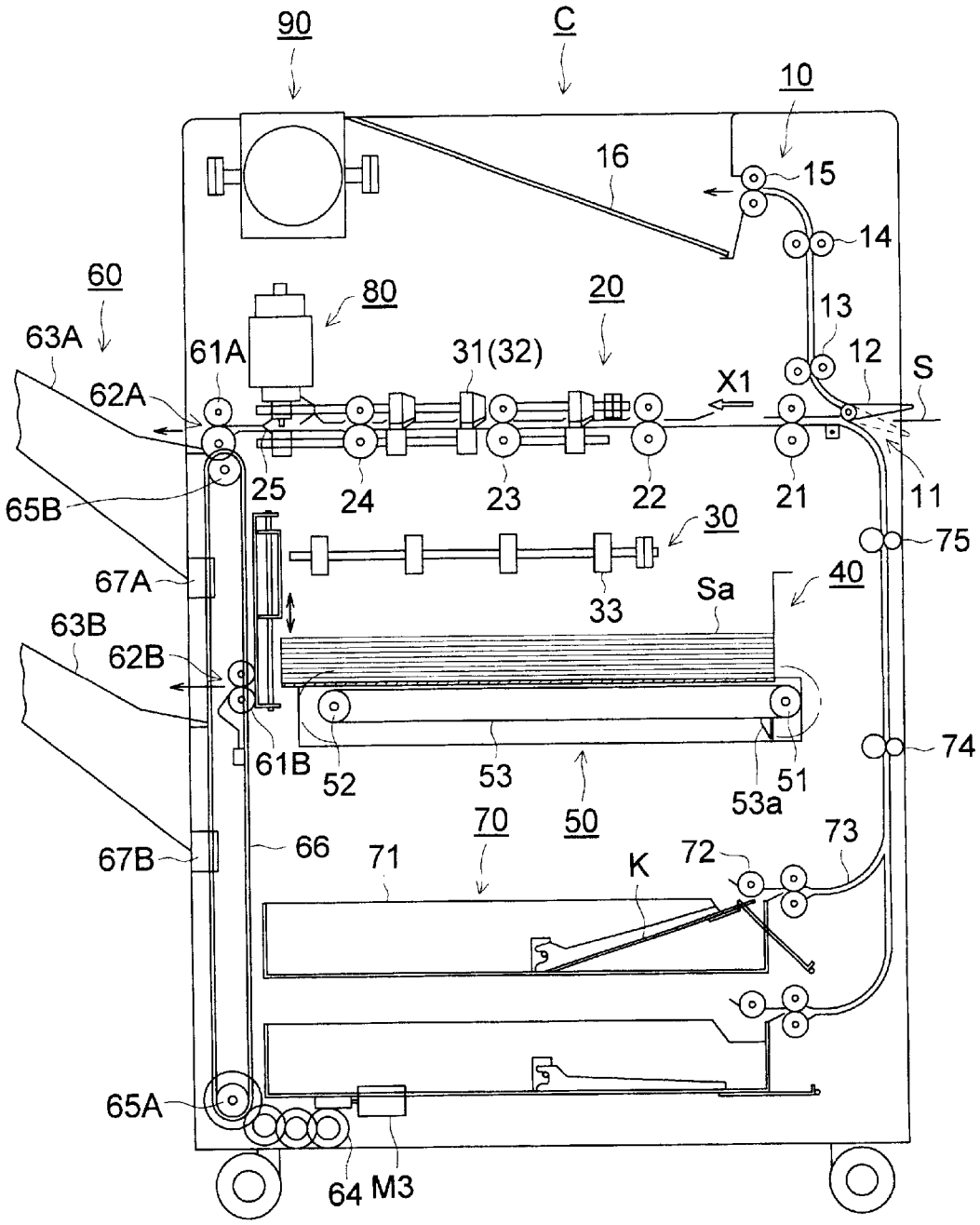
FIG. 2 is an elevational sectional view of the pasting and bookbinding apparatus.

FIG. 2 is an elevational sectional view of the pasting and bookbinding apparatus C. The sheet S introduced into a receiving section 11 is selected to either one of the direct sheet delivery means 10 or horizontal conveying means 20 by the switching plate 12.

(Direct Sheet Delivery onto a Fixed Sheet Delivery Tray 16 in the Upper Portion of the Apparatus)

The sheet S introduced into the direct sheet delivery means 10 is conveyed upward, and held by the conveying rollers 13, 14 and delivered onto the fixed sheet delivery tray 16 by the delivery roller 15.

(Shift Processing or Non-sort Large Amount Sheet Delivery, Sheet Delivery onto the First Sheet Delivery Tray 63A)

When the apparatus is set to this conveying mode, the switching plate 12 closes the conveying path of the direct sheet delivery means 10, and opens the conveying path of the horizontal conveying means 20, and enables the sheet S to pass.

The sheet S introduced in the horizontal conveying means 20 is conveyed being held by the conveying rollers 21, 22, 23, and 24, and the sheet S on which the paste coating processing is not conducted, is held by the first delivery roller 61A via a shit means, not shown, and delivered onto the first sheet delivery tray 63A provided outside the apparatus (the first conveying path).

On the first sheet delivery tray 63A, the sheet S delivered from the first delivery port 62A is stacked, and by up and down drive, a large amount of sheets S can be accommodated.

(Sheet Conveyance for the Paste Coating Processing)

Figure 3:
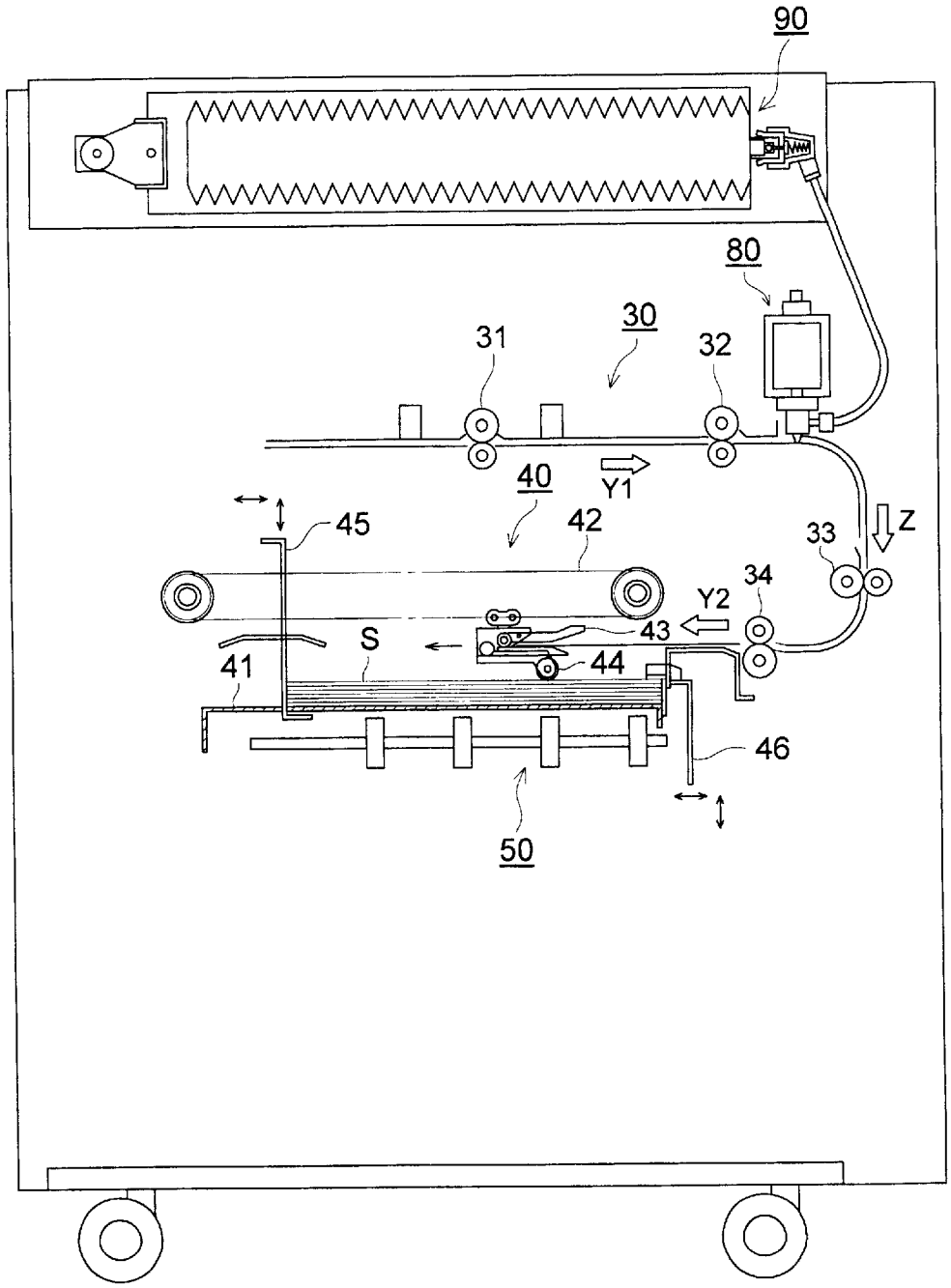
FIG. 3 is a side view of the pasting and bookbinding apparatus.
Figure 4:
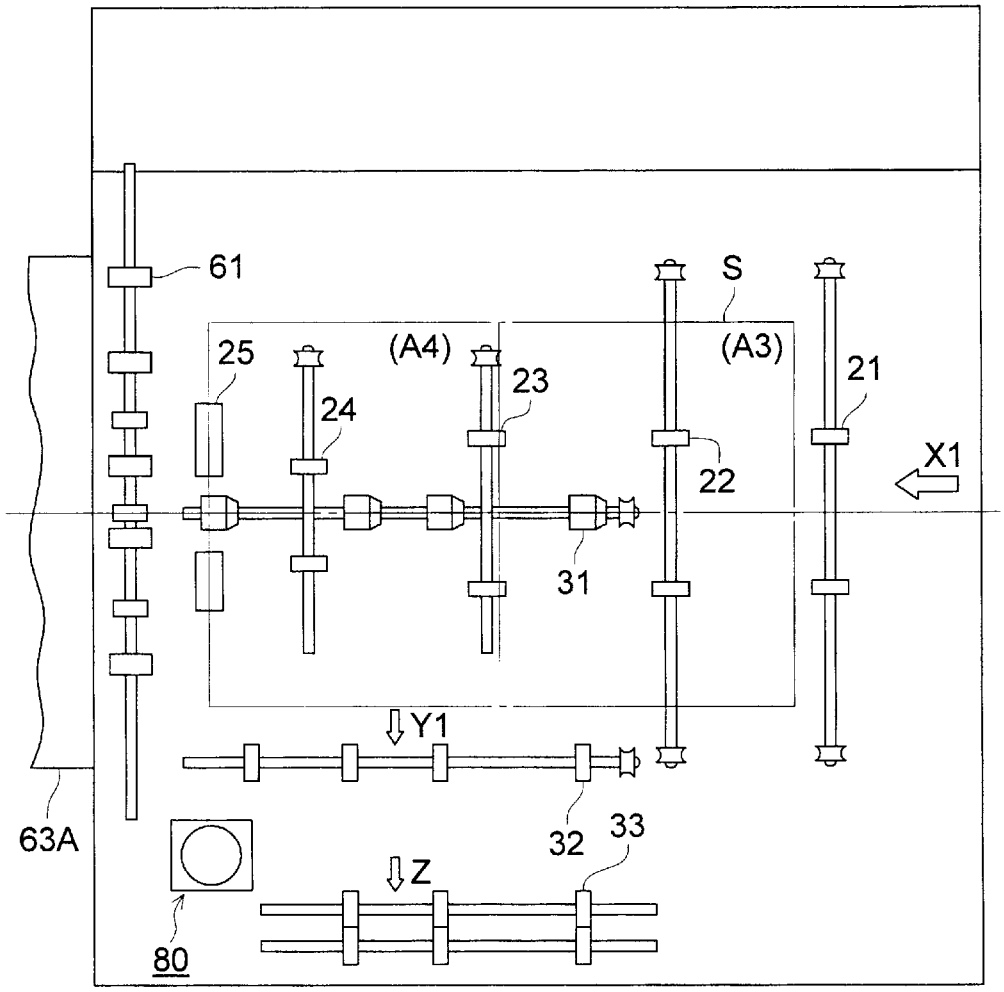
FIG. 4 is a plan view of the pasting and bookbinding apparatus.
Figure 5:
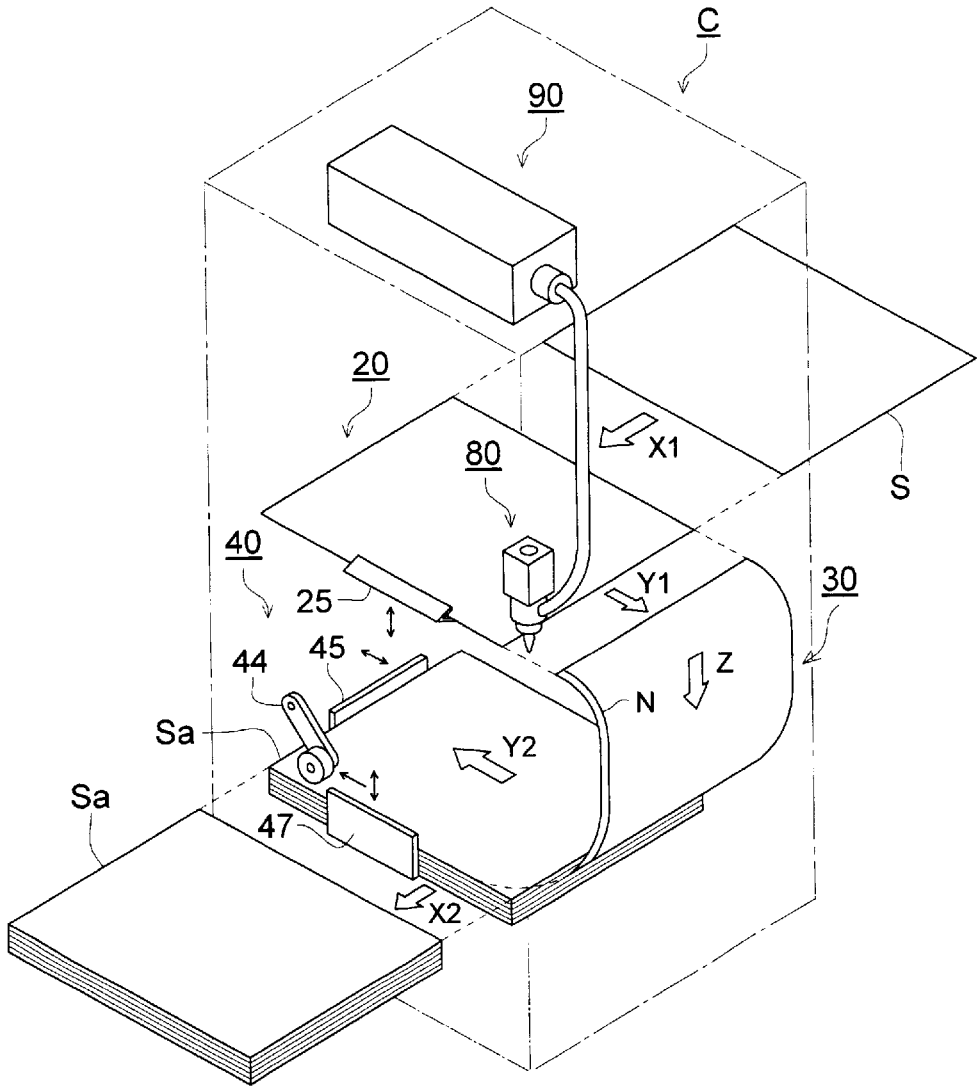
FIG. 5 is a typical perspective view for explaining a sheet conveying path at the time of paste coating processing and the paste coating processing.
Figure 6:
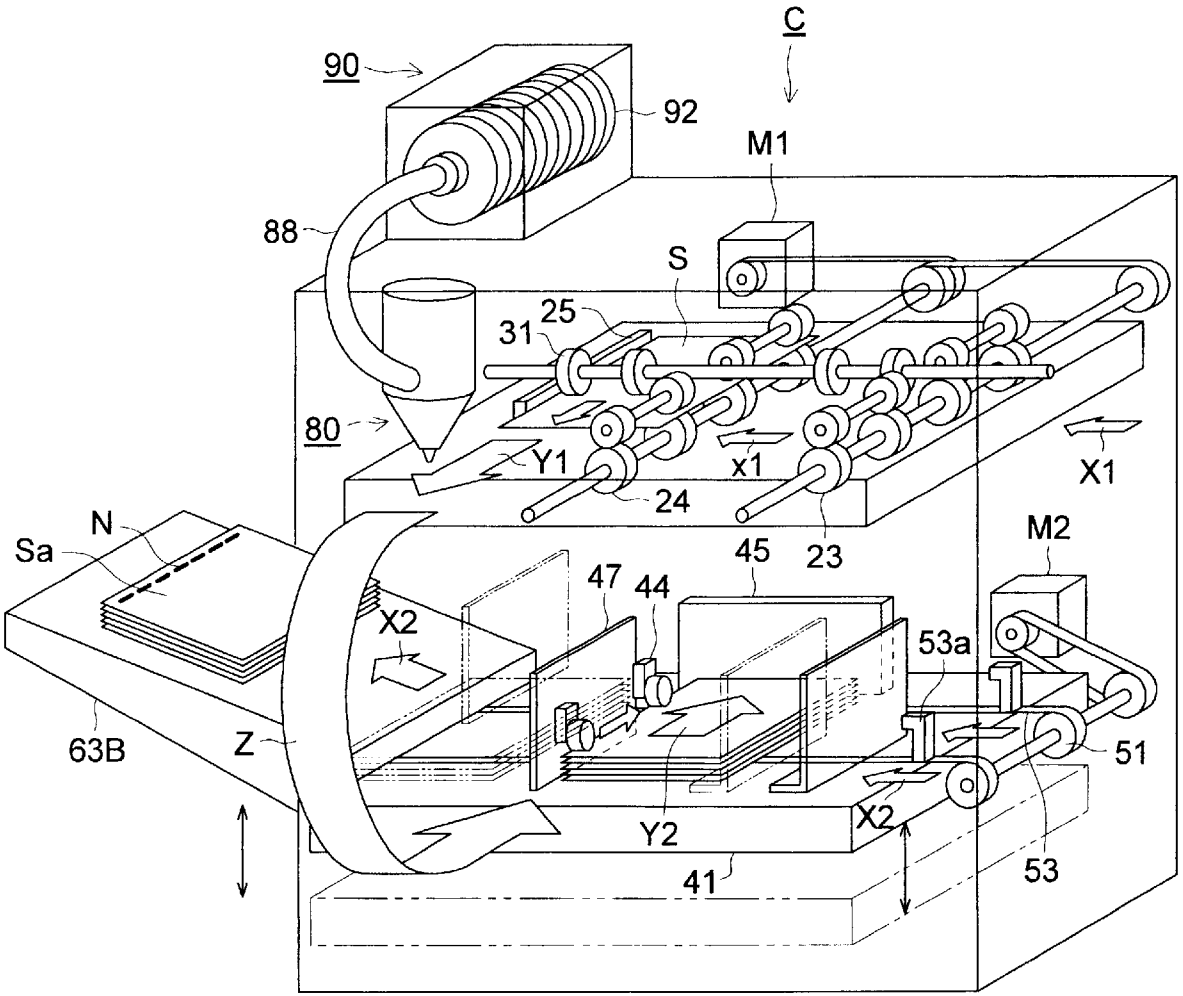
FIG. 6 is a typical perspective view for explaining a sheet conveying path at the time of paste coating processing and the paste coating processing.

FIG. 3 is a side view of a pasting and bookbinding apparatus C, and FIG. 4 is a plan view. FIG. 5 and FIG. 6 are typical perspective views for explaining the sheet conveying path at the time of the paste coating processing and the paste coating processing.

Orthogonal U-turn conveyance of the sheet by the direction change conveying means 30:

When the apparatus is set to the pasting and bookbinding processing mode, the sheet S delivered from the image forming apparatus main body A is held by the conveying rollers 21–24 rotated by a motor M1 and conveyed. When the leading edge portion of the sheet S comes into contact with the movable contact member 25, the skew of the sheet S is corrected, and the positioning of the conveyance direction is conducted (the first conveying path of the X1 direction in FIG. 2 and FIG. 3). After that, the drive of the motor M1 is stopped, and each of upper rollers of the conveying rollers 21–24 is withdrawn from the sheet surface to the upward, by a drive means, not shown, and the pressure contact of the conveying rollers 22–24 is released.

Further, the sheet S is held by the conveying rollers 31 and 32 rotated by a drive source, not shown, and conveyed to the conveying direction deflected by 90° (the second conveying path of the Y1 direction in FIG. 3 and FIG. 4). Successively, the sheet S is held by the conveying roller 33 and 34 and U-turn-conveyed and sent to a stacking means 40 (the third conveying path in the Z direction in FIG. 3).

Cover sheet feeding means:

In the lower portion of the pasting and bookbinding apparatus C, 2 stage cover sheet feeding means 70 is arranged. The cover sheet feeding means 70 is structured by a sheet feed cassette 71, sheet feed member 72, sheet feed path 73, and conveying rollers 74, 75. One of cover sheets K accommodated in the sheet feed cassette 71 is sent out by a sheet feed member 72, and passes a sheet feed path 73, and held by conveying rollers 74, 75, and introduced to the conveying roller 21 of the first conveying path. The cover sheet K introduced to the first conveying path is pasting and bookbinding processed as a front cover, back cover, or intermediate sheet of a plurality of sheets S delivered from the image forming apparatus main body A.

Paste coating processing onto the sheet S:

A paste jetting means 80 jets the paste linearly or intermittently broken line-like onto one side edge portion of the sheet S traveling from the Y1 direction to the Z direction by the conveying rollers 31–34, and forms the paste coating portion N on the upper surface of the sheet S (refer to FIG. 5).

The paste used in the embodiment of the present invention is a water-soluble paste of vinyl acetate resin emulsion type, and whose viscosity is 750–1500 Pa·s at normal temperature. The booklet adhered with the water-soluble paste can be used as recycling paper.

Stacking, aligning, and pressing processing of the sheet S:

The first sheet S which is not paste coating-processed is held and conveyed to the fourth conveying path in the Y2 direction by the conveying rollers 33, 24, and stacked on the sheet stacking table 41. Following sheets S subsequent to the second paste coating-processed sheet, are held and conveyed to the Y2 direction by the conveying rollers 33, 34, and stacked on the preceding sheet S on the sheet stacking table 41.

That is, the leading edge portion of the sheet S held and conveyed by the conveying roller 34 is held by a gripper means 43 held by a rotating endless-like belt 42, and conveyed to the Y2 direction above the sheet stacking table 41. A pressing means 44 held by the moving gripper means 43 presses the back surface side of the paste coating portion N forming surface of the preceding sheet set stacked on the sheet stacking table 41 and moved, and the adhesion among the sheets is made sure. The leading edge of the sheet S held by the gripper means 43 comes into contact with a leading edge stopper 45, and the leading edge is aligned. The leading edge stopper 45 can be moved by a drive means, not shown, and stops at a predetermined position by a size setting of the sheet S. The trailing edge of the sheet S is subjected to the alignment of the sheet trailing portion and the pressing of the sheet trailing edge upper portion by a sheet trailing edge alignment pressing means 46 which is movably driven. Both side edge portions of the sheet S are positioned by a side edge stopper 47 and an alignment means, not shown. In this connection, the alignment and positioning of the leading edge portion, trailing edge portion, both side edge portion of the sheet S are conducted before the pressing processing by the pressing means 44. The pressing processing of the sheet S by the pressing means 44 may also be conducted every time when the sheet S of the second sheet and subsequent is stacked on the sheet stacking table 41. Alternatively, the pressing processing may also be conducted at each time when a plurality of sheets S are stacked.

By the above processes, a bookbinding which is pasting processed is completed. In this pasting and bookbinding apparatus C, for example, the pasting processing and bookbinding can be conducted on the maximum 2000 sheets S.

Sheet delivery:

On a portion of the sheet stacking surface of the sheet stacking table 41, a plurality of delivery belts 53 wound around a drive roller 51 and a driven roller 52 are rotatably arranged. A motor M2 drives the drive roller 51 and rotates the delivery belt 53.

A final sheet S is stacked on the sheet stacking table 41, and pressing processed, and a trailing edge portion of a pasted and book-bound booklet Sa is held by a delivery claw 53*a* of the delivery belt 53, and slides on the stacking surface of the sheet stacking table 41, and held by the second delivery roller 61B provided to the second delivery port 62B of the delivery means 60 and delivered onto the second delivery tray 63B and stacked (the fifth conveying path in the X2 direction). Prior to this delivery sheet processing, the pressing means 44 and side edge stopper 47 are withdrawn to the above of the conveying path by a drive means, not shown.

On the second sheet delivery tray 63B, the booklet Sa which is delivered from the second delivery port 62B and paste coating processed, can be stacked, and by the up and down drive, a large amount of booklets Sa can be accommodated.

A motor M3 provided in the vicinity of a bottom portion of the pasting and bookbinding apparatus C drives a drive pulley 65A through a reduction gear train 64, and a wire 66 wound around the drive pulley 65A and a driven pulley 65B is made rotatable. Onto the wire 66, a base portion of the first sheet delivery tray 63A is fixed by an engagement member 67A, and a base portion of the second sheet delivery tray 63B is fixed by an engagement member 67B. By a forward and backward drive of the motor M3, the first sheet delivery tray 63A and the second sheet delivery tray 63B connected to the rotating wire 66 go up and down along a rail, not shown.

(Paste Jetting Means)

Figure 7:
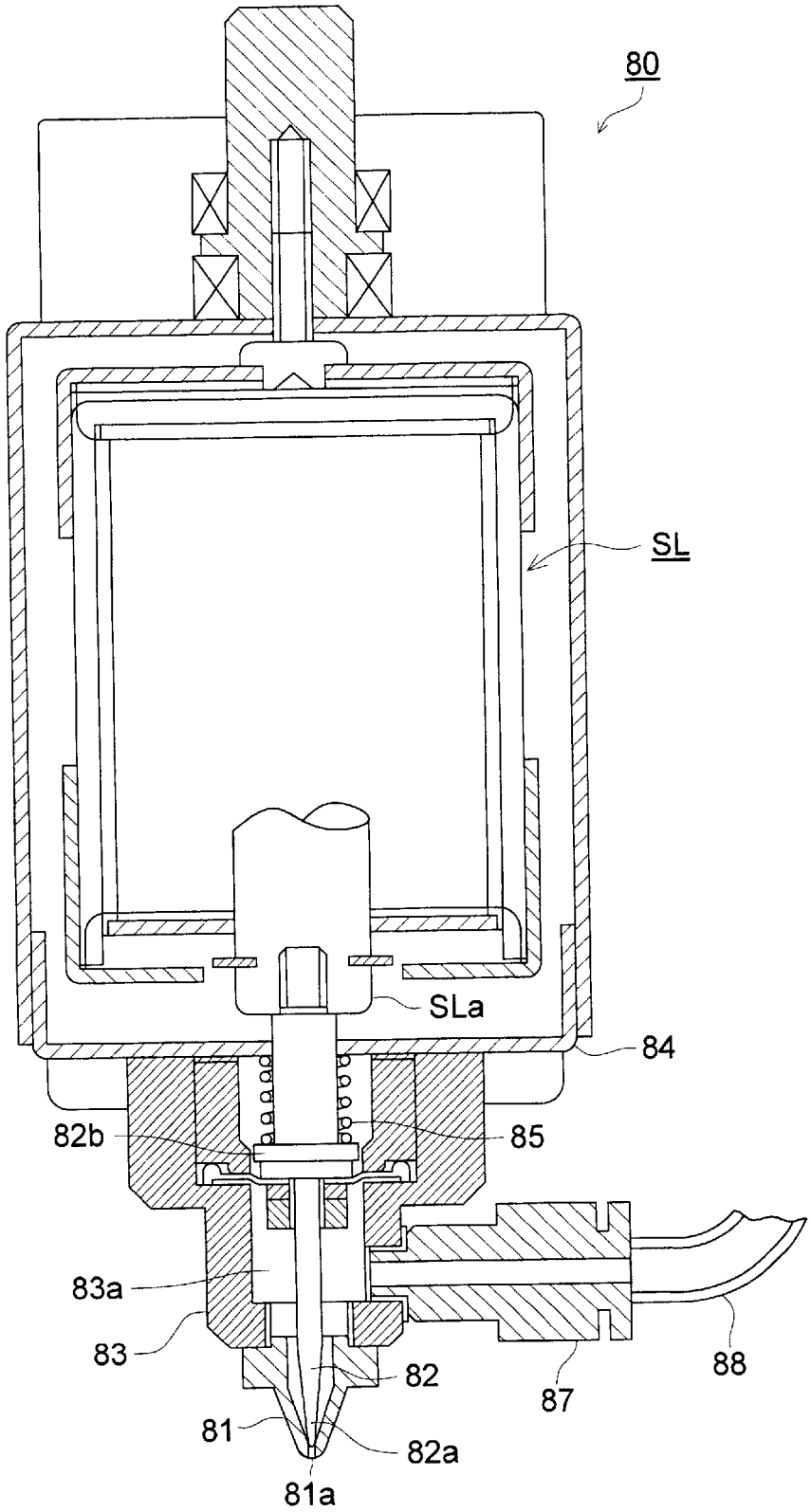
FIG. 7 is a sectional view of a paste jetting means.

FIG. 7 is a sectional view of a paste jetting means 80.

The paste jetting means 80 is structured by a nozzle member 81 having an opening portion 81*a* to jet the paste, a movable needle member (hereinafter, called needle) 82 which opens and closes the opening portion 81*a*, casing 83 which accommodates the needle 82 movably, and solenoid (drive means) SL which drives the needle 82 movably.

A return spring 85 is inserted between a bottom portion of a housing 84 of the paste jetting means 80 and the upper surface of a flange portion 82*b*, and presses the needle 82 downward, and by the leading edge portion 82*a* of the needle 82, the opening portion 81*a* of the nozzle member 81 is closed.

When the voltage is applied onto a solenoid SL, a plunger Sla is moved upward, and the needle 82 directly connected to the plunger Sla is pulled up, and opens the opening 81*a* of the nozzle member 81 and enables the paste to be jetted.

A inlet member 87 is fixed on the side surface of the casing 83, and the paste supplied from a paste supply means 90, which will be described later, is introduced into a paste accommodation chamber 83*a* through a supply tube 88.

(Paste Supply Means)

Figure 8:
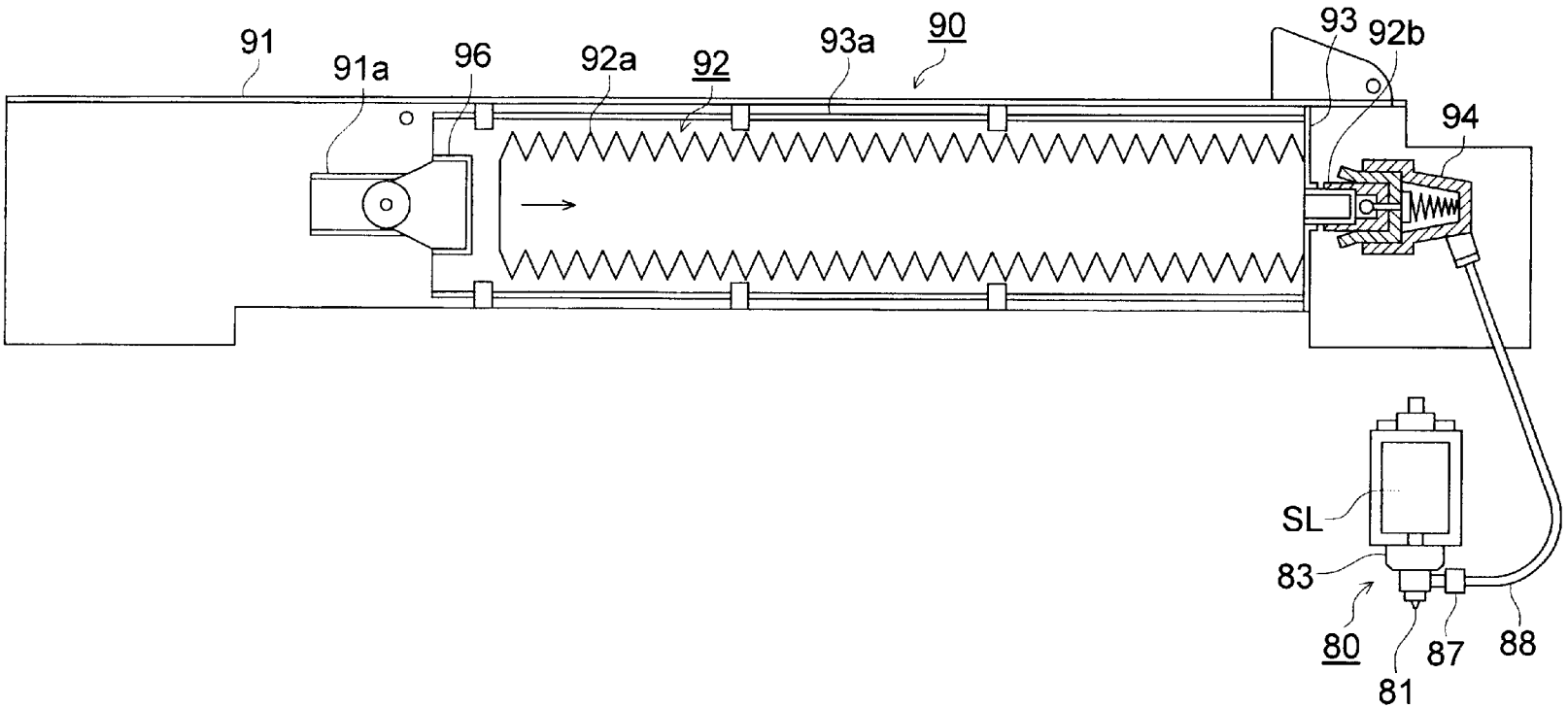
FIG. 8 is a front view of a paste supply means.

FIG. 8 is a front view of the paste supply means 90 applied for the pasting and bookbinding apparatus of the present invention, and FIG. 90 is a front view showing a drive means of the paste supply means 90.

In the housing 91 of the paste supply means 90, a paste accommodation vessel 92 is detachably mounted. The paste accommodation vessel 92 is composed of a vessel main body 92*a* to accommodate the paste and a nozzle portion 92*b* to deliver the paste. For the vessel main body 92*a*, a flexible member such as polyethylene is used, and the vessel main body 92*a* is formed into the bellow shape which is molded thin wall hollow-like, and is capable of expansion and contraction.

The vessel main body 92*a* of the paste accommodation vessel is held, and loaded into the vessel accommodation chamber 93*a* of the housing 91, and the nozzle portion 92*b* of the paste accommodation vessel 92 is connected to a vessel mounting means 93. This connection motion may be manually conducted, but the electrically driven drive means is speedy and sure.

Figure 9:
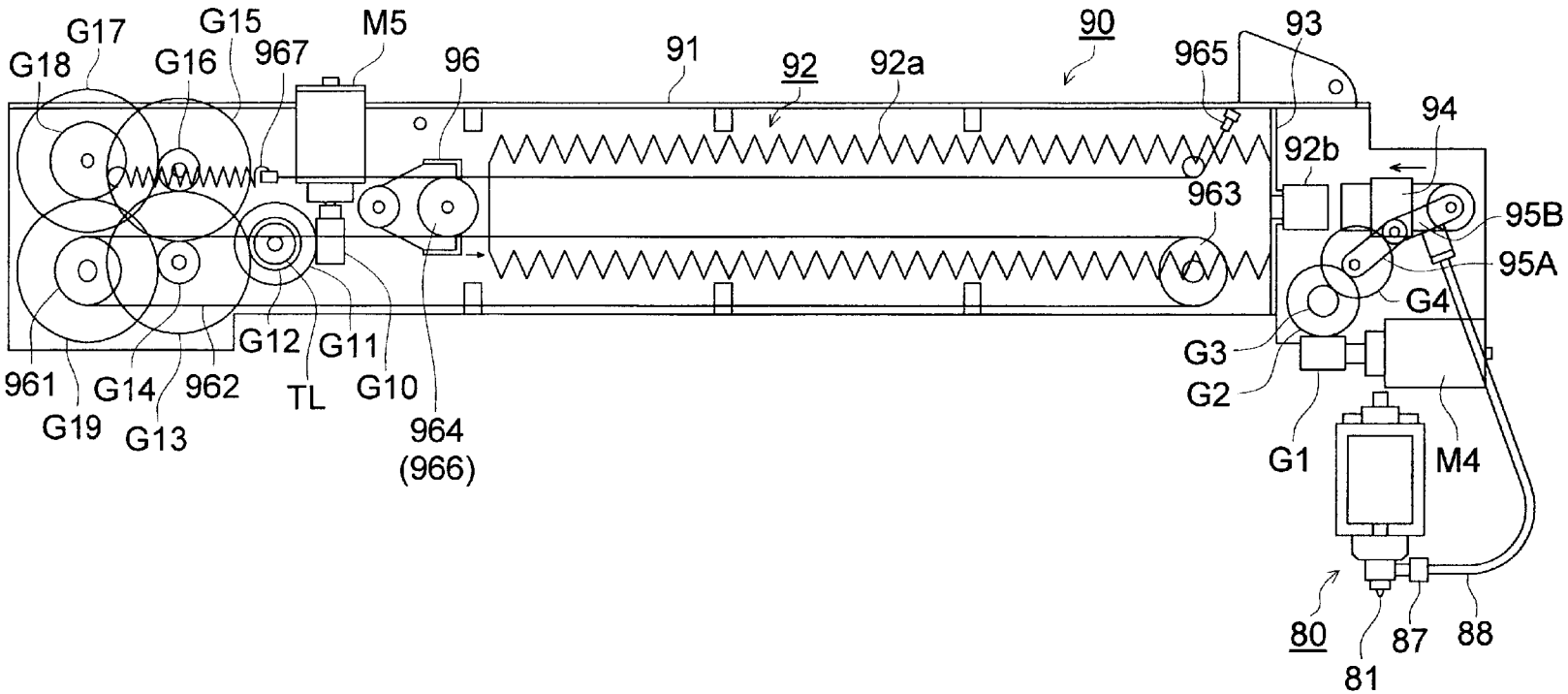
FIG. 9 is a front view showing a drive means of the paste supply means.

On the vessel mounting means 93 side of the housing 91, the drive means of a supply tube side connecting member 94 is arranged (refer to FIG. 9). A motor M4 of the drive means oscillates a crank 95A through gears G1–G4 forming the reduction gear train. A Crank 95B connected to the oscillated crank 95A straightly forwards the supply tube side connecting member 94 to the arrowed direction. The supply tube side connecting member 94 further straight forwards and is connected to the nozzle portion 92*b* and stops. In this connected condition, the pressurized paste in the vessel main body 92*a* passes the nozzle portion 92*b* and supply tube side connecting member 94, and is supplied to the paste jetting means 80 through the supply tube 88 and inlet member 87 of the paste jetting means 80.

The other end bottom portion of the vessel main body 92*a* opposite to the nozzle portion 92*b* of the paste accommodation vessel 92 is pressed by a drive means of a pressing means 96, and moves in the arrowed direction along a guide groove 91*a*.

A drive means of the pressing means 96 is shown in FIG. 9. A motor M5 of the drive means rotates a pulley 961 through gears G10–G19 forming the reduction gear train. A wire 962 winding around the pulley 961 winds around a pulley 963, and winds around a pulley 964 supported by the pressing means 96, and its one end is fixed to a fixing support member 965.

The other end of the wire 962 winding around the pulley 961 is wound around a pulley 966 on a coax, and connected to the other end of a tension spring 967 whose one end is supported by the housing 91.

The pressing means 96 moves in the arrowed direction through the reduction gear train and wire 962 by the normal rotation of the motor M5, and compresses the vessel main body 92*a*. The pressurized paste in the vessel main body 92*a* passes the nozzle portion 92*b* and supply tube side connecting member 94, and through the supply tube 88 and the inlet member 87 of the jetting means 80, it is supplied to the paste jetting means 80.

On the coax to the gears G11, 12, a torque limiter TL is mounted, and when the pressing force onto the vessel maim body 92*a* by the motor M5 is larger than a predetermined pressure, the gears G11 and 12 are idly rotated and the transmission is cut by the torque limiter, and the movement of the pressing means 96 is stopped.

The pasting and bookbinding apparatus C is connected to a copier, printer, or image forming apparatus into which these devices are integrated. A desired digital processing is conducted by the image forming apparatus, and after processing of the single side recording, double sides recording, or page edition, the delivered sheet S is book covering and pasting processing are exactly and effectively conducted, and bookbinding is conducted by the image forming apparatus provided with the pasting and bookbinding apparatus C of the present invention.

In this connection, the pasting and bookbinding apparatus C of the present invention is formed into an independent apparatus, and the pasting and bookbinding can also be conducted on the sheets processed by other image forming apparatus.

As can seen from the above description, according to the pasting and bookbinding method, pasting and bookbinding apparatus and image forming apparatus of the present invention, the following effects can be obtained.

(1) According to the pasting and bookbinding method, and pasting and bookbinding apparatus according to Structures (1) and (2) of the present invention, when the sheet conveying path of the pasting and bookbinding apparatus is arranged three-dimensionally, the sheet conveying path is reduced, and the size of the apparatus is reduced, and the productivity of the pasting and bookbinding is increased. Further, when the booklet which is pasting and bookbinding processed is accommodated on the sheet delivery tray outside the pasting and bookbinding apparatus, the bookbinding processed booklet can be easily taken out. Further, during the pasting and bookbinding processing, the preceding pasting and bookbinding processed booklet can be easily taken out.

(2) According to the pasting and bookbinding apparatus according to Structure (3) of the present invention, when the sheet delivery tray is arranged in 2 stages, because, corresponding to the pasting and bookbinding mode and the direct sheet delivery mode including the shift processing in which the pasting and bookbinding processing is not conducted, each of exclusive delivery trays is distinguished and can be stacked, the mixing of the sheets in both modes can be prevented.

(3) According to the image forming apparatus according to Structure (4) of the present invention, the stable pasting and bookbinding processing is conducted on the large number of sheets continuously delivered at high speed from the image forming apparatus main body, and the large number of booklets can be stably produced continuously.

(Another Embodiment of the Image Forming Apparatus)

Figure 10:
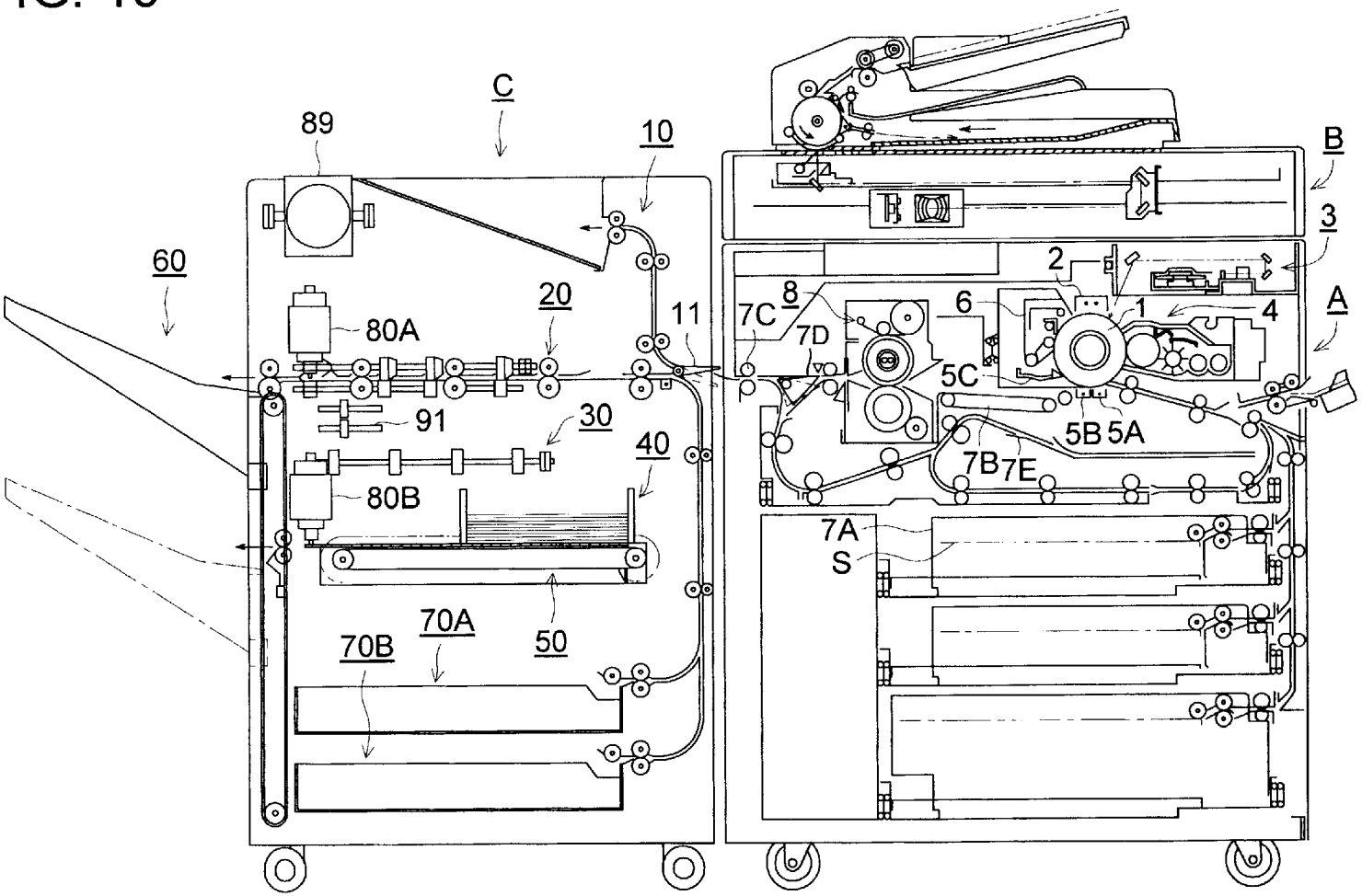
FIG. 10 is an overall structural view of another image forming system composed of the image forming apparatus main body, image reading apparatus, and pasting and bookbinding apparatus.

FIG. 10 is an overall structural view of another image forming system composed of the image forming apparatus main body A, image reading apparatus B, and pasting and bookbinding apparatus C. The same numerals and signs as in the above embodiment have the same function and mode of operation, and the explanation of them will be neglected.

(The Embodiment of the Pasting and Bookbinding Apparatus)

The pasting and bookbinding apparatus C is structured by the uppermost stage sheet delivery means 10, the horizontal conveying means 20 below it, direction change conveying means 30, sheet accommodation portion 40, delivery means 50, sheet delivery means 60, sheet conveying apparatus composed of the front cover feeding means 70A and back cover feeding means 70B, and the paste coating apparatus composed of the first paste jetting means 80A and paste supply apparatus 89.

(Sheet Set Production Function)

Figure 11:
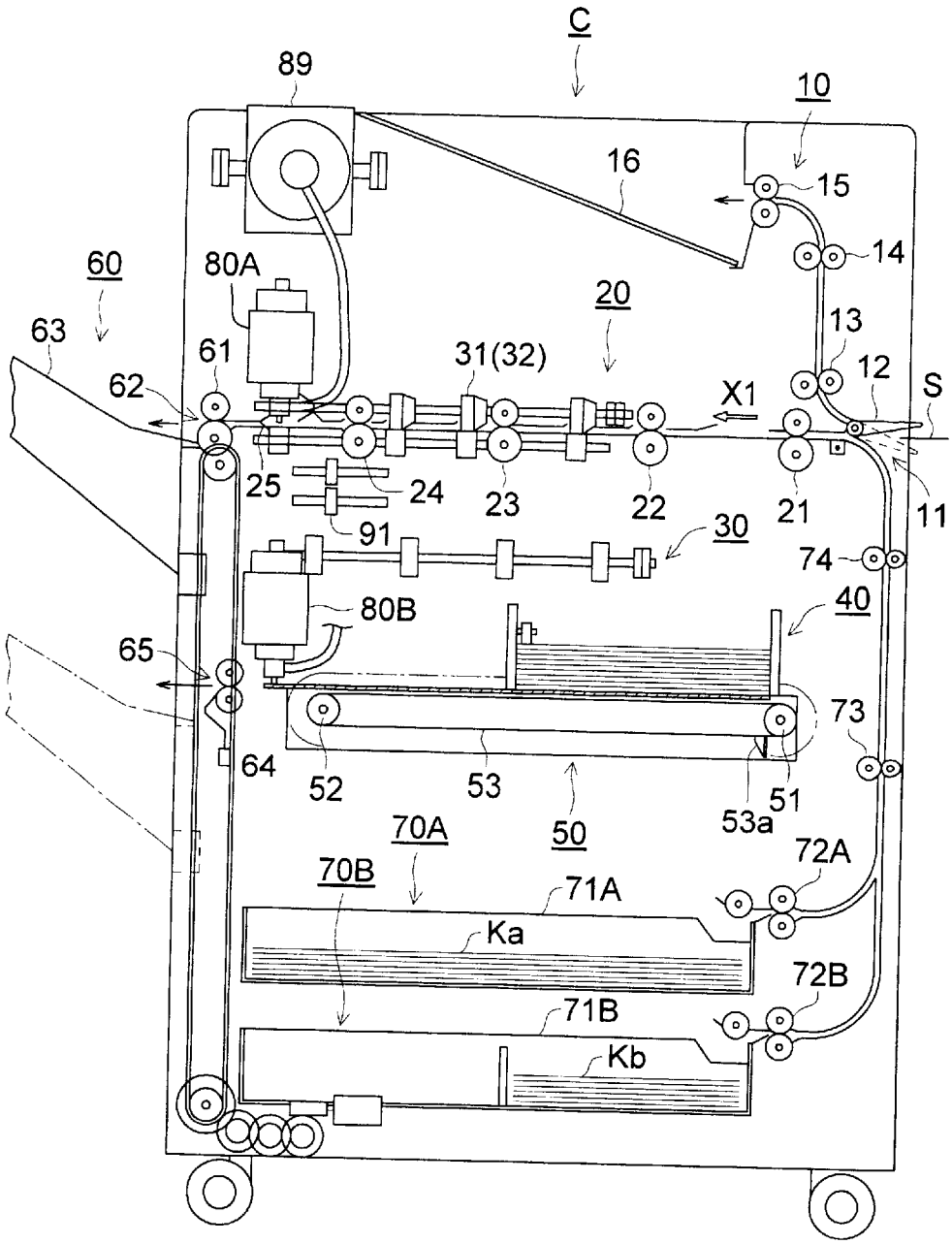
FIG. 11 is an elevational sectional view of the pasting and bookbinding apparatus.

FIG. 11 is an elevational sectional view of the pasting and bookbinding apparatus C.

(Sheet Conveyance for the Paste Coating Processing)

Figure 12:
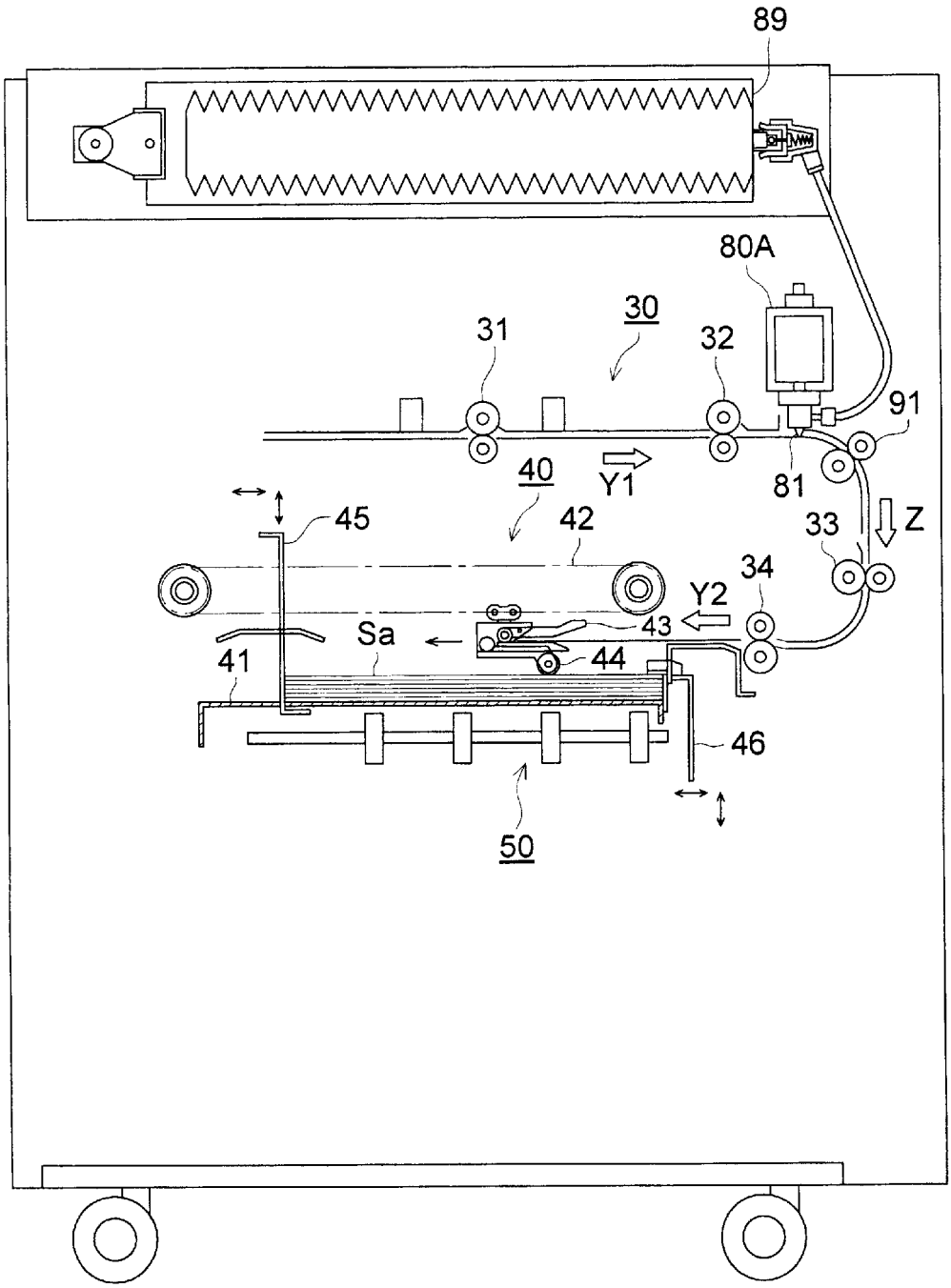
FIG. 12 is a side view of the pasting and bookbinding apparatus.
Figure 13:
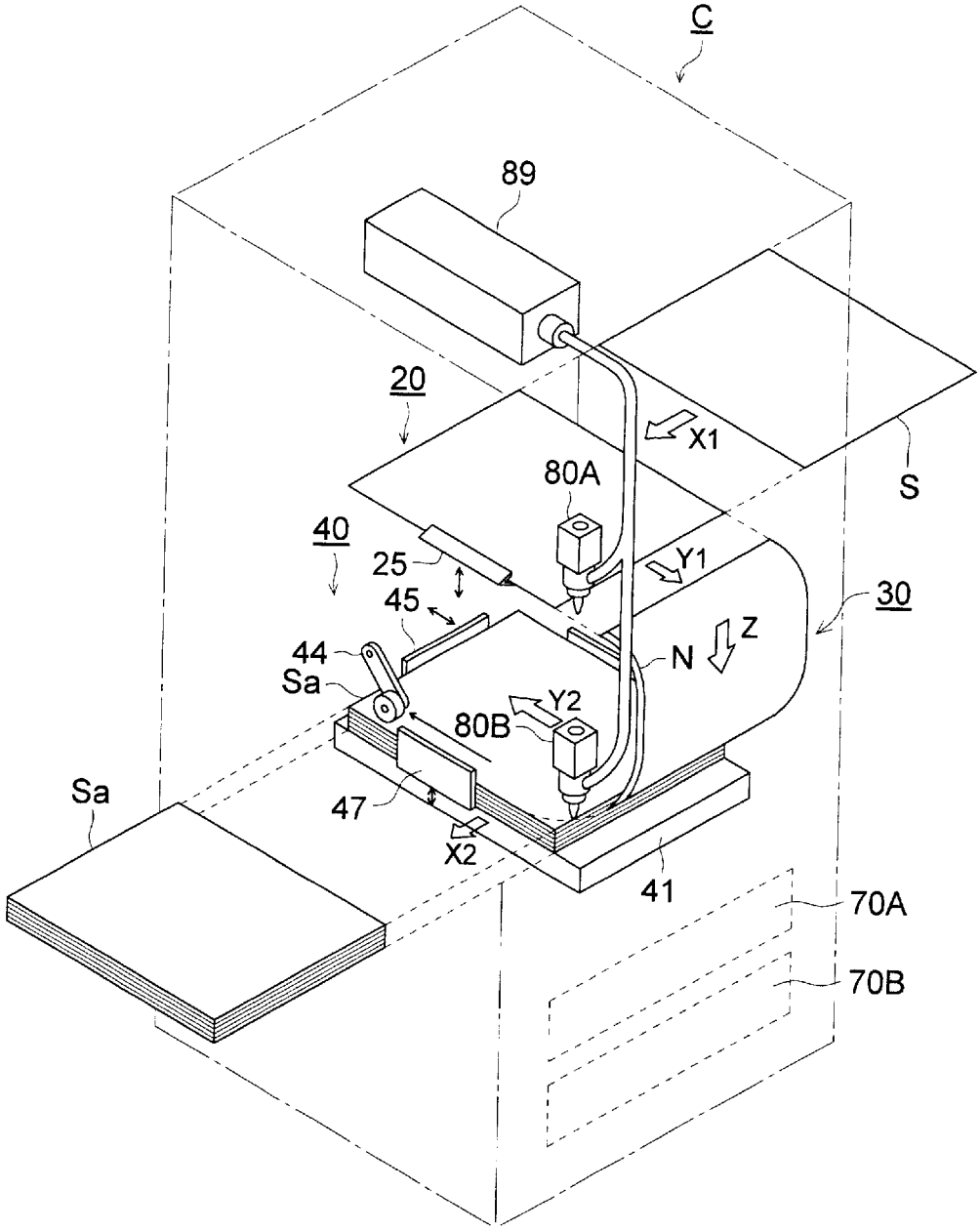
FIG. 13 is a typical perspective view for explaining the sheet conveying path at the time of paste coating processing and the paste coating processing.
Figure 14:
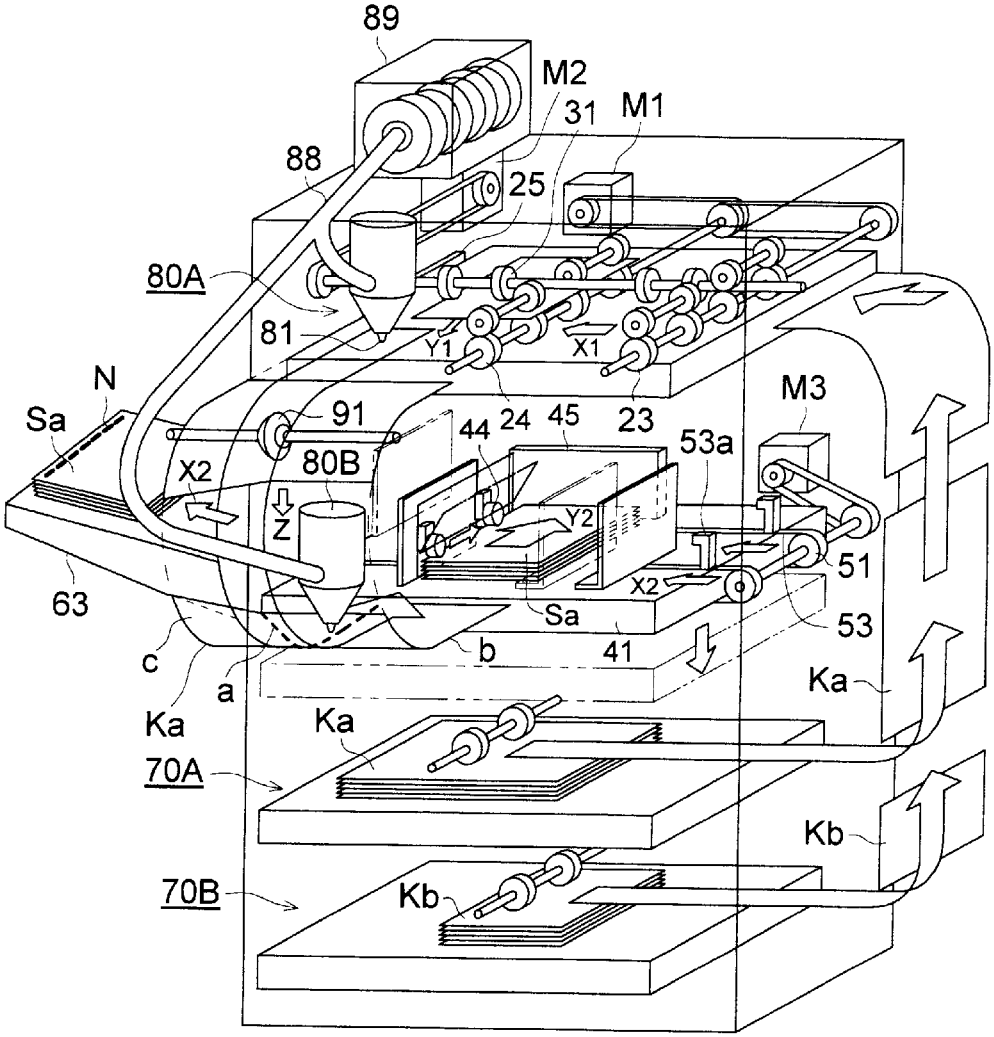
FIG. 14 is a typical perspective view for explaining the sheet conveying path at the time of paste coating processing and the paste coating processing.

FIG. 12 is a side view of a pasting and bookbinding apparatus C. FIG. 13 and FIG. 14 are typical perspective views for explaining the sheet conveying path at the time of the paste coating processing and the paste coating processing.

Orthogonal U-turn conveyance of the sheet by the direction change conveying means 30:

When the apparatus is set to the pasting and bookbinding processing mode, the sheet S delivered from the image forming apparatus main body A is held by the conveying rollers 21–24 rotated by a motor M1 and conveyed. When the leading edge portion of the sheet S comes into contact with the positioning member 25, the skew of the sheet S is corrected, and the positioning of the conveyance direction is conducted (the first conveying path X1 in the arrowed direction in FIGS. 11–14). After that, the drive of the motor M1 is stopped, and each of upper rollers of the conveying rollers 21–24 is withdrawn from the sheet surface to the upward, by a drive means, not shown, and the pressure contact is released.

Further, the sheet S is held by the conveying rollers 31 and 32 rotated by a motor M2, and conveyed to the conveying direction deflected by 90° (the second conveying path Y1 in the arrowed direction in FIGS. 12–14). Successively, the sheet S is held by the conveying roller 33 and 34 and U-turn-conveyed and sent to a sheet accommodation section 40 (the third conveying path Z in the arrowed direction in FIGS. 12–14).

(Paste Coating Processing onto the Sheet S)

The first paste jetting means 80A jets the paste linearly or intermittently broken line-like onto one side edge portion of the sheet S traveling from the second conveying path Y1 to the third conveying path Z by the conveying rollers 31–34, and forms the paste coating portion N on the upper surface of the sheet S (refer to FIGS. 15(*a*)–15(*d*)).

FIGS. 15(*a*)–15(*d*) are plan views showing each kind of paste coating portions formed in the vicinity of side edge portions of the sheet S. FIG. 15(*a*) shows a continuous linear paste coating portion N1. FIG. 15(*b*) shows a broken line-like paste coating portion N2 which is written intermittently with a predetermined interval. FIG. 15(*c*) shows a dotted line-like paste coating portion N3 which is written intermittently with a predetermined interval. FIG. 15(*d*) shows a linear paste coating portion N4 formed on the side of a short side of the sheet S.

Because the linear paste coating portions N1 and N4 fixedly adhere between sheets ranging over the whole length in the vicinity of the side edge portion of the sheet S, the durability of the booklet is enough and the finishing quality is good. Because any of the broken like-like paste coating portion N2 and dotted line-like paste coating portion N3 has a small adhesive agent pasting area, the adhesive strength between sheets is weaker than the paste coating portions N1 and N4, and the tensile strength is slightly low.

(Stacking, Aligning, and Pressing Processing of the Sheet S)

(Refer to FIG. 12 and FIG. 13)

The first sheet S which is not paste coating-processed is held and conveyed to the fourth conveying path Y2 by the rotated conveying rollers 33, 34, and stacked on the sheet stacking table 41. The succeeding second and subsequent paste coating-processed sheets S are held and conveyed to the fourth conveying path Y2 by the conveying rollers 33, 34, and stacked on the preceding sheet S on the sheet stacking table 41.

That is, the leading edge portion of the sheet S held and conveyed by the conveying roller 34 is held by a gripper means 43 held by a rotating endless-like belt 42, and conveyed to the Y2 direction above the sheet stacking table 41. A pressing means 44 held by the moving gripper means 43 presses the back surface side of the paste coating portion N forming surface of the preceding sheet set stacked on the sheet stacking table 41 and moved, and the adhesion among the sheets is made sure. The leading edge of the sheet S held by the gripper means 43 comes into contact with a leading edge stopper 45, and the leading edge is aligned. The leading edge stopper 45 can be moved by a drive means, not shown, and stops at a predetermined position by a size setting of the sheet S. The trailing edge of the sheet S is subjected to the alignment of the sheet trailing portion and the pressing of the sheet trailing edge upper portion by a sheet trailing edge alignment pressing means 46 which is movably driven. Both side edge portions of the sheet S are positioned by a side edge stopper 47 and an alignment means, not shown. In this connection, the alignment and positioning of the leading edge portion, trailing edge portion, both side edge portion of the sheet S are conducted before the pressing processing by the pressing means 44. The pressing processing of the sheet S by the pressing means 44 may also be conducted every time when the sheet S of the second sheet and subsequent is stacked on the sheet stacking table 41. Alternatively, the pressing processing may also be conducted at each time when a plurality of sheets S are stacked.

By the above processes, a bookbinding which is pasting processed is completed. In this pasting and bookbinding apparatus C, for example, the pasting processing and bookbinding can be conducted on the maximum 2000 sheets S.

(Sheet Delivery)

On a portion of the sheet stacking surface of the sheet stacking table 41, a plurality of delivery belts 53 wound around a drive roller 51 and a driven roller 52 are rotatably arranged.

A final sheet S is stacked on the sheet stacking table 41, and pressing processed, and a trailing edge portion of a pasted and book-bound booklet is held by a delivery claw 53*a* of the delivery belt 53 rotated by a motor M3, and slides on the stacking surface of the sheet stacking table 41, and held by the second delivery roller 64 provided to the second delivery port 65 of the delivery means 60 and delivered onto the up and down sheet delivery tray 63 and stacked (the fifth conveying path X2 in the arrowed direction). Prior to this delivery sheet processing, the pressing means 44 and width alignment means 47 are withdrawn to the above of the conveying path by a drive means, not shown.

On the up and down sheet delivery tray 63, the sheet S which is delivered from the first delivery port 62 and not paste coating processed, and the booklet which is delivered from the second delivery port 65 and paste coating processed, can be stacked, and a large amount of sheets S and booklets can be accommodated by the up and down drive.

(Cover Bookbinding Production Function)

The paste coating and bookbinding apparatus C of the present invention has the sheet set production function by which the paste coating and bookbinding processing is conducted between sheets, and the cover bookbinding production function by which the front cover and back cover are adhered onto the front and rear surfaces of the sheet set Sa and the paste coating and bookbinding processing is conducted.

A mechanism of the cover bookbinding production function is, as shown in FIG. 14, provided with a creasing roller 91, the second paste jetting means 80B, front cover sheet feeding means 70A, and back cover sheet feeding means 70B.

The creasing roller 91 is provided on the downstream side of the second conveying path Y1, and creases the first fold a on the conveying front cover Ka, and folds it into a loose V-character shape, and forms the front cover surface portion b which is the same size as the sheet S, and back cover portion c.

The second paste jetting means 80B has the same structure as the first paste jetting means. The second paste jetting means 80B is provided below the first paste jetting means 80A, and at the upstream side of the fourth conveying path Y2, and forms the paste coating portion Na during the sheet conveyance, in the vicinity of the side edge portion of the upper surface (rear surface side) of the final sheet Sn forming the sheet set Sa (refer to FIG. 22). Accordingly, in the vicinity of the side edge portion of the final sheet Sn, the paste coating portion N on the sheet front surface side by the first paste jetting means 80A and the paste coating portion Na on the sheet rear surface side by the second paste jetting means 80B are formed.

The front cover sheet feeding means 70A of the upper stage shown in FIG. 11 is structured by a sheet feed cassette 71A to accommodate the front cover Ka and sheet feeding section 72A. A sheet of front cover Ka fed from the sheet feeding cassette 71A by the sheet feeding section 72A passes the conveying rollers 73 and 74, and through the horizontal conveying means 20 and direction change conveying means 30, the first fold a is creased by the creasing roller 91 and the cover Ka is sent into the sheet accommodation section 40.

The back cover sheet feeding means 70B of the lower stage shown in FIG. 11 is structured by a sheet feed cassette 71B to accommodate the back cover Kb and sheet feeding section 72B. A sheet of back cover Kb fed from the sheet feeding cassette 71B by the sheet feeding section 72B passes the conveying rollers 73 and 74, and is sent to the horizontal conveying means 20, and through the direction change conveying means 30, the cover Kb is sent into the sheet accommodation section 40, and superimposed on the upper surface of the sheet set Sa, and the pasting and bookbinding is conducted thereon.

FIGS. 16(*a*)–16(*j*) are perspective views showing the process in which the front cover Ka and the back cover Kb are pasted on the sheet set Sa and cover book-bound, and FIGS. 17(*a*)–21(*c*) are perspective views showing the detail of the pasting and cover bookbinding process by the pasting and bookbinding apparatus.

(1) The front cover Ka conveyed in the second conveying path Y1 direction by the conveying roller 32 is creased the first fold a by a pair of creasing rollers 91, and folded into a loose V character shape, and forms the cover surface portion b of the same size as the sheet S and the back cover portion c. The folded front cover Ka is sent to the third conveying path Z direction, and further, sent to the fourth conveying path Y2 direction (refer to FIGS. 17(*a*), 17(*b*)).

The folded front cover Ka is reversal-conveyed along the third conveying path Z and the fourth conveying path Y2, and with the back cover portion c facing upward, conveyed onto the sheet stacking table 41, and the width direction is regulated by a sheet alignment pressing means 46, and the cover Ka is brought into contact with a leading edge stopper 45 and stopped (refer to FIG. 17(*c*), FIG. 16(*a*)).

(2) A back fold support plate 92 supported in the withdrawn position above the sheet stacking table 41 is lowered, and the vicinity of the first fold a of the cover surface portion b of the front cover Ka stacked on the sheet stacking table 41 is vertically pressed and supported. Next, the first creasing means 93 supported in the withdrawn position below the sheet stacking table 41 comes close to the back surface side of the of the back folding supporting plate 92 and is elevated, and presses the back cover portion c, and folds the loosely folded back cover portion c at almost a right angle along the first fold a (refer to FIGS. 18(*a*), 16(*b*)).

(3) After the right angle folding of the front cover Ka, the back folding support plate 92 is elevated and stops at a withdrawn position, and almost simultaneously, the sheet alignment pressing means 46 is also withdrawn from the alignment position, and the reception of the subsequent sheet S is made possible. The succeeding sheet S on which the paste coating portion N is formed, passes the same conveying path as the front cover Ka, and is conveyed to the sheet accommodation portion 40 with the paste coating portion facing downward. The leading edge portion of the sheet S is brought into contact with the leading edge stopper 45 and stopped, and the sheet S is stacked on the upper surface of the cover surface portion b of the front cover Ka. The sheet alignment pressing means 46 is moved to the direction perpendicular to the sheet conveying direction every time when the sheet S is stacked on the upper surface of the front cover Ka, and presses the side edge portion of the sheet S, and the sheet S is brought into contact with the back cover portion c of the front cover Ka, and the width of the sheet S is aligned (refer to FIG. 18(*b*), FIG. 16(*c*)).

(4) The sheet S in which the succeeding second and subsequent sheet is paste coating processed, is stacked on the preceding sheet S on the sheet stacking table 41, and its width direction is aligned by the sheet alignment pressing means 46. The lowered and moving pressing means 44 successively presses the back surface side of the paste coating portion N of the sheet S and the sheet set Sa is formed (refer to FIGS. 19(*a*), 16(*d*)).

The pressing processing of the sheet S by the pressing means 44 may also be conducted every time when the sheet S of the second and subsequent sheet is stacked on the sheet stacking table 41. Alternatively, the pressing processing may also be conducted every time when a plurality of the sheets S are stacked.

Figure 22:
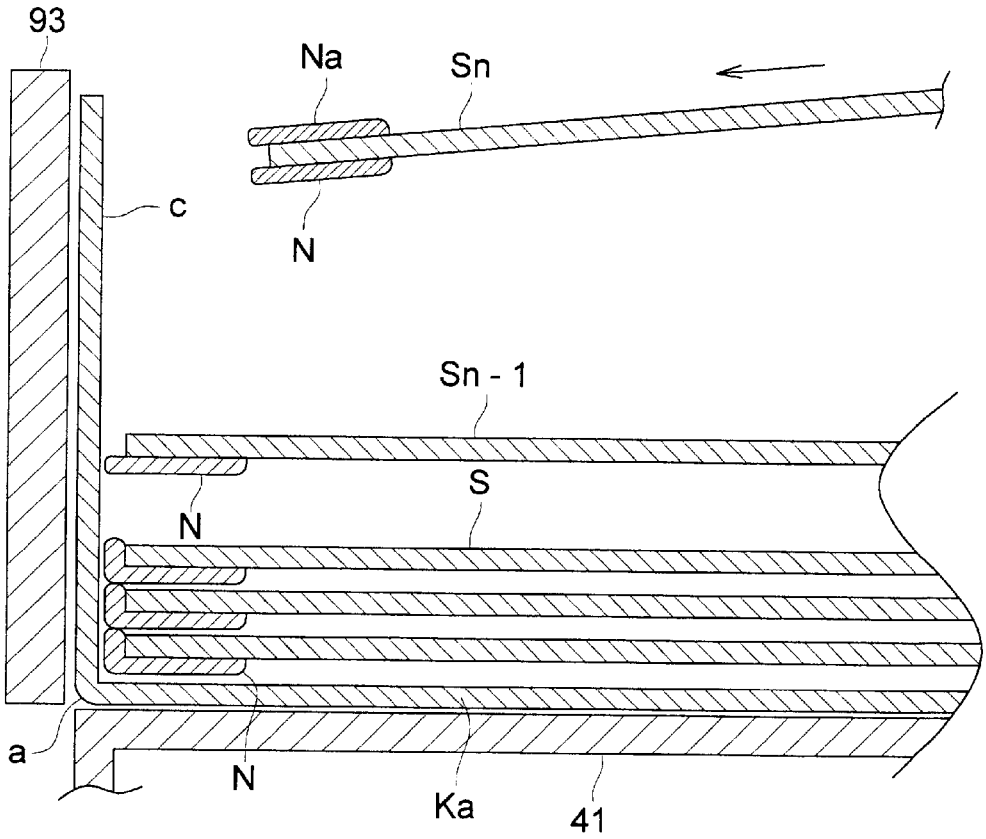
FIG. 22 is a partially enlarged sectional view of a sheet stacked on a sheet stacking table.

FIG. 22 is a partially enlarged sectional view of the sheet S stacked on the sheet stacking table 41. The sheet S on which the paste coating portion is formed, is stacked on the preceding front cover Ka or sheet S and at the time of sheet width alignment, the pasted side edge portion of the sheet S and the back cover portion c of the front cover Ka are adhered, and the front cover Ka and the sheet S, and a portion between sheets are adhered by the paste coating portion N.

(5) In FIG. 22, in the vicinity of the side edge portion of the final sheet Sn, after the paste coating portion N of the sheet surface side by the first paste jetting means 80A, and the paste coating portion Na of the sheet rear surface side by the second paste jetting means 80B are formed, they are stacked on the preceding sheet S, and at the time of the sheet width alignment, the pasted side edge portion of the final sheet Sn and the back cover potion c of the front cover Ka are adhered, and the front cover Ka and the sheet S, and a portion between sheets are adhered by the paste coating portion N.

After the alignment, adhesion, and pressing to the sheet Sn−1 which is one sheet before the final sheet Sn are completed, the pressing means 44 does not press onto the final sheet Sn, and is withdrawn upward. After the final sheet Sn is stacked on the sheet set Sa and adhered, the first creasing means 93 is lowered, and its leading edge portion is lowered to the uppermost surface position of the sheet set Sa and stopped (refer to FIG. 19(*b*), FIG. 16(*e*)).

(6) The second creasing means 94 horizontally advances by the drive means, and forms the second fold d on the front cover Ka, and folds it at a right angle, and forms a turn-up portion (refer to FIG. 19(*c*), FIG. 16(*c*)).

(7) The second creasing means 94 goes back and is withdrawn at an initial position, and the back folding support plate 92 is lowered, and presses the upper surface side of the turn-up portion of the front cover Ka, and the turn-up portion is adhered onto the paste coating portion Na of the final sheet Sn (refer to FIG. 20(*a*), FIG. 16(*g*)).

Figure 21:
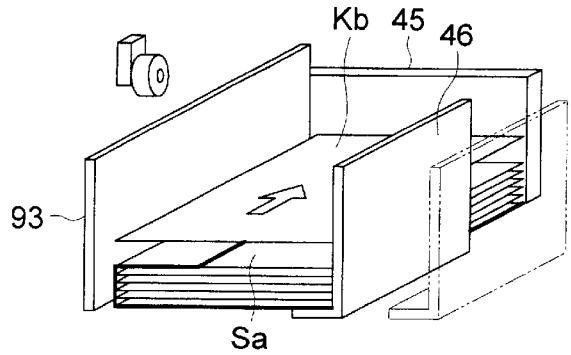
FIGS. 21(*a*)–21(*c*) are perspective views showing a detail of the pasting by the pasting and bookbinding apparatus and the cover bookbinding production process.
Figure 21:
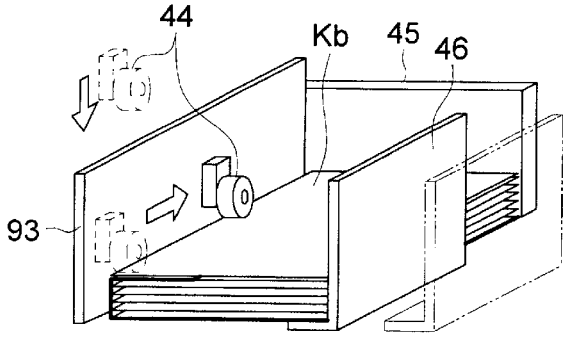
Figure 21:
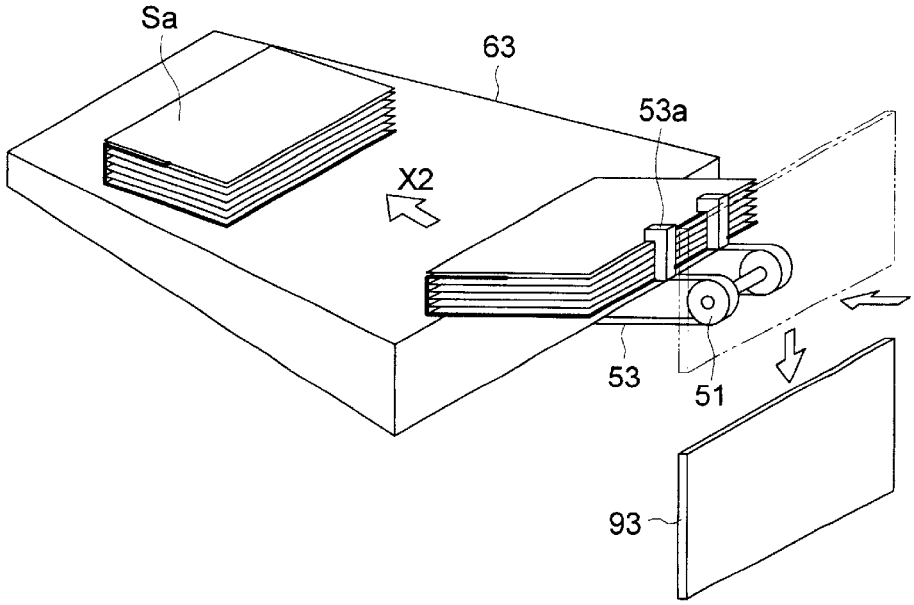

(8) The back cover Kb is conveyed in the same manner as the sheet S, and sent to the sheet stacking table 41 with the paste coating portion N facing downward, and the side edge portion of the back cover Kb is pressed by the sheet alignment pressing means 46 and the width is aligned and stacked onto the uppermost layer of the sheet set Sa and turn-up portion of the front cover Ka, and adhered to the paste coating portion Na of the final sheet Sn (refer to FIG. 20(*b*), FIG. 21(*a*), FIG. 16(*h*)).

(9) The upper surface side of the adhered surface of turn-up portion of the front cover Ka and the back cover Kb is pressed by the pressing means 44, and the adhesion is strengthened (refer to FIG. 21(*b*), FIG. 16(*i*)).

(10) The first creasing means 93 is lowered, and withdrawn at the initial position below. The paste coating and bookbinding processed sheet set Sa is held at the trailing edge portion of the booklet by the delivery claw 53*a* of the rotating delivery belt 53, and delivered and stacked onto the up and down delivery tray 63 (the fifth conveying path X2 in the arrowed direction). (Refer to FIG. 21(*c*), FIG. 16(*j*)).

FIG. 23(*a*) is a perspective view showing the finishing of the cover bookbinding, and FIG. 23(*b*) is a perspective view showing the cover bookbinding under the condition that the back cover is half opened.

In this connection, the pasting and bookbinding apparatus C of the present invention is also formed into an independent apparatus, and the paste coating and bookbinding may also be produced for the sheet processed by another image forming apparatus.

As can clearly be seen from the above description, the following effects can be obtained by the pasting and bookbinding method, pasting and bookbinding apparatus, and image forming apparatus of the present invention.

(1) According to the pasting and bookbinding method and pasting and bookbinding apparatus described in the method and apparatus (5), (6) of the present invention, when the sheet set production function by which portions between the sheets are adhered and the booklet is produced, and the cover bookbinding production function to adhere the front cover and back cover and sheet set and to produce the booklet are integrally structured into the integrated pasting and bookbinding apparatus, the structure of the apparatus is simplified, and the high quality booklet can be produced.

(2) According to the image forming apparatus provided with the pasting and bookbinding apparatus described in the method (7) of the present invention, for the sheet conveyed at a high speed from the image forming apparatus main body, without lowering the high speed productivity, by the pasting and bookbinding apparatus, the stable sheet conveyance and the paste coating processing to form the uniform paste coating portion can be conducted, and the bookbinding processing can be continuously and automatically conducted.

(Yet Another Embodiment of the Image Forming Apparatus)

Figure 24:
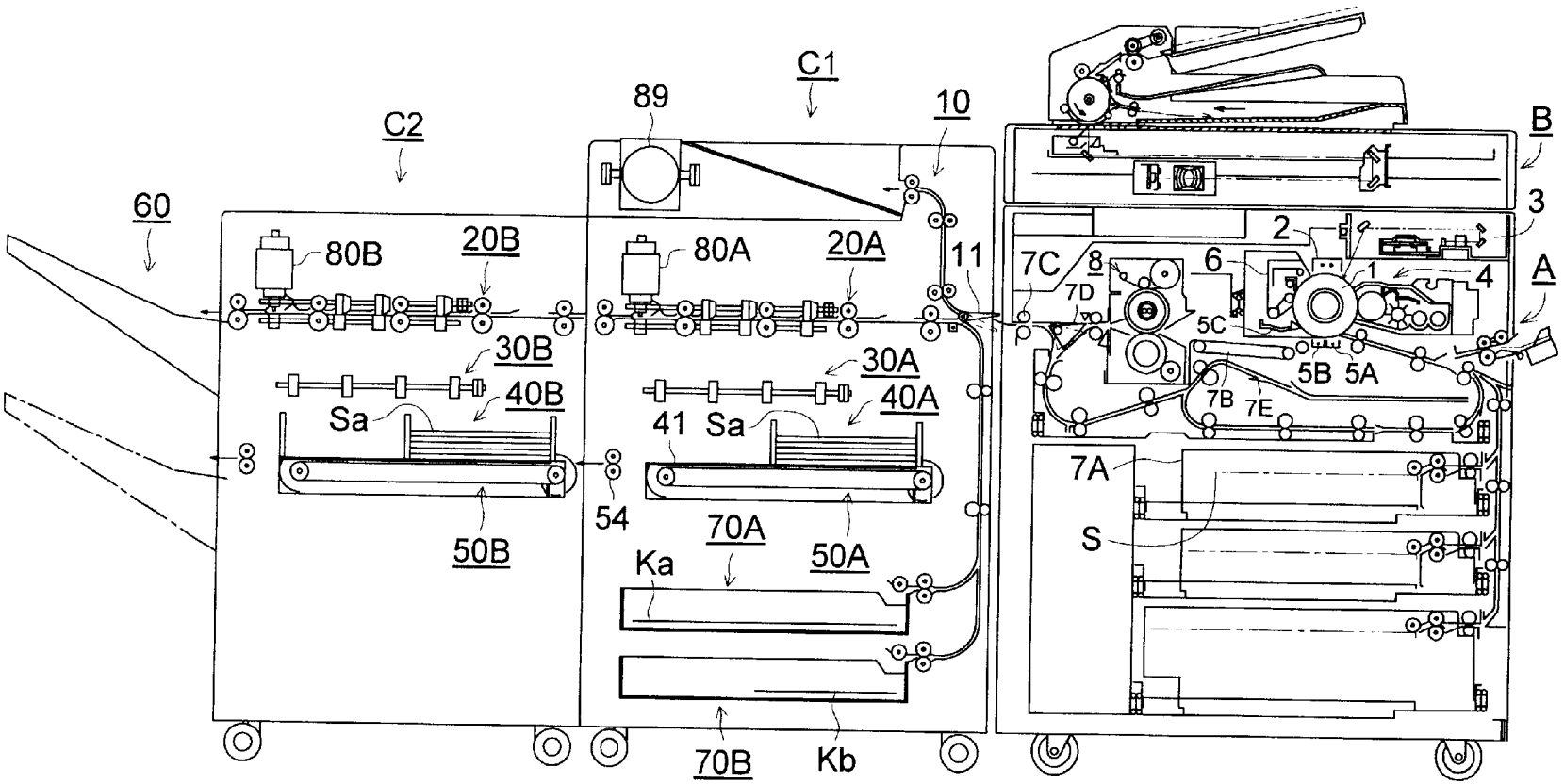
FIG. 24 is an overall structural view of an image forming system composed of the image forming apparatus main body, image reading apparatus, the first pasting and bookbinding apparatus, and the second pasting and bookbinding apparatus.

FIG. 24 is an overall structural view of an image forming system composed of the image forming apparatus main body A, image reading apparatus B, first paste coating and bookbinding apparatus C1, and second paste coating and bookbinding apparatus C2. The same signs and numerals as in the above embodiment have the same functions and modes of operation, and the explanation of them will be neglected.

(Pasting and Bookbinding Apparatus)

The paste coating and bookbinding apparatus is composed of the first paste coating and bookbinding apparatus C1 connected to the sheet delivery portion side of the image forming apparatus main body A and the second paste coating and bookbinding apparatus C2 connected to the sheet delivery port and the sheet set delivery port of the first paste coating and bookbinding apparatus C1.

(The First Pasting and Bookbinding Apparatus C1)

Figure 25:
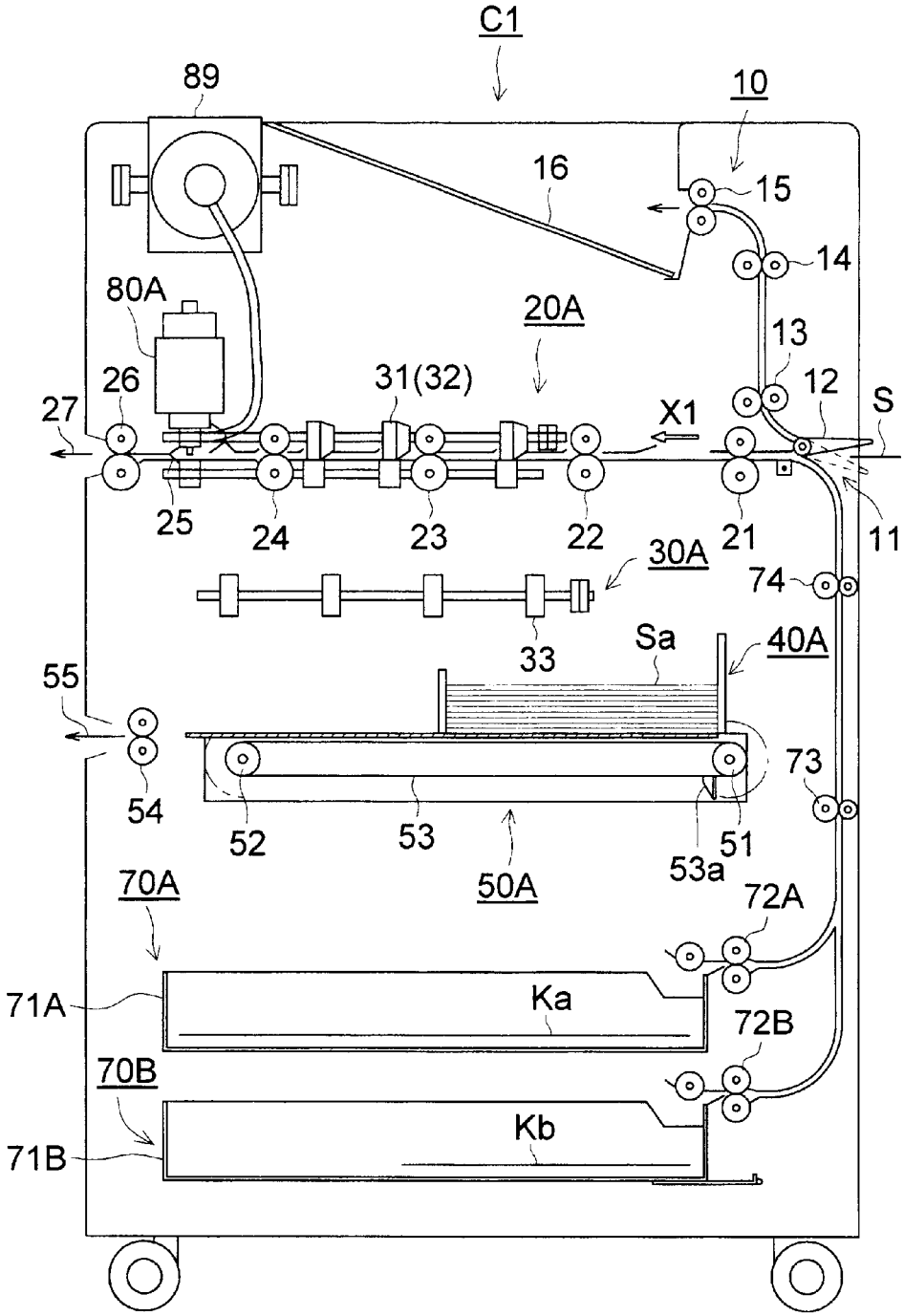
FIG. 25 is an elevational sectional view of the first pasting and bookbinding apparatus.

FIG. 25 is an elevational sectional view of the first pasting and bookbinding apparatus (sheet set production apparatus) C1.

The first pasting and bookbinding apparatus C1 is structured by the uppermost stage direct sheet delivery means 10, horizontal conveying means 20A below it, direction change conveying means 30A, sheet accommodation section 40A, delivery means 50A, sheet conveying apparatus composed of the first sheet feeding means (front cover sheet feeding means) 70A and the second sheet feeding means (back cover sheet feeding means) 70B, and the first paste jetting means 80A, and paste supply apparatus 89.

The sheet S introduced into the reception portion 11 is selected to either one of the above direct sheet delivery means 10 or the horizontal conveying means 20A.

The sheet S introduced into the direct sheet delivery means 10 is conveyed upward, and held by the conveying rollers 13, 14, and delivered onto the fixed sheet delivery tray 16 by the delivery roller 15.

When the apparatus is set to the conveyance mode of the shift processing or non-sort large amount of sheet delivery, the switching plate 12 closes the conveying path of the direct sheet delivery means 10, and the conveying path of the horizontal conveying means 20A is opened, and the passage of the sheet S is made possible. The sheet S introduced into the horizontal conveying means 20A is held by conveying rollers 21, 22, 23 and 24, and conveyed, and the sheet S on which the paste coating processing is not conducted, is held by the sheet delivery roller 26 through the shift means, not shown, and introduced from the upper delivery port 27 into the second pasting and bookbinding apparatus C2, which will be described later. The sheet S which is introduced into the second pasting and bookbinding apparatus and on which the paste coating processing is not conducted, is held by the horizontal conveying means 20B and conveyed, and held by the delivery roller 61 and delivered from the upper delivery port 62 onto the up and down sheet delivery tray 63 outside the apparatus. On the up and down sheet delivery tray 63, for example, a large amount of sheets S of the maximum 3000 sheets can be stacked.

(Sheet Conveyance for the Paste Coating Processing)

Figure 26:
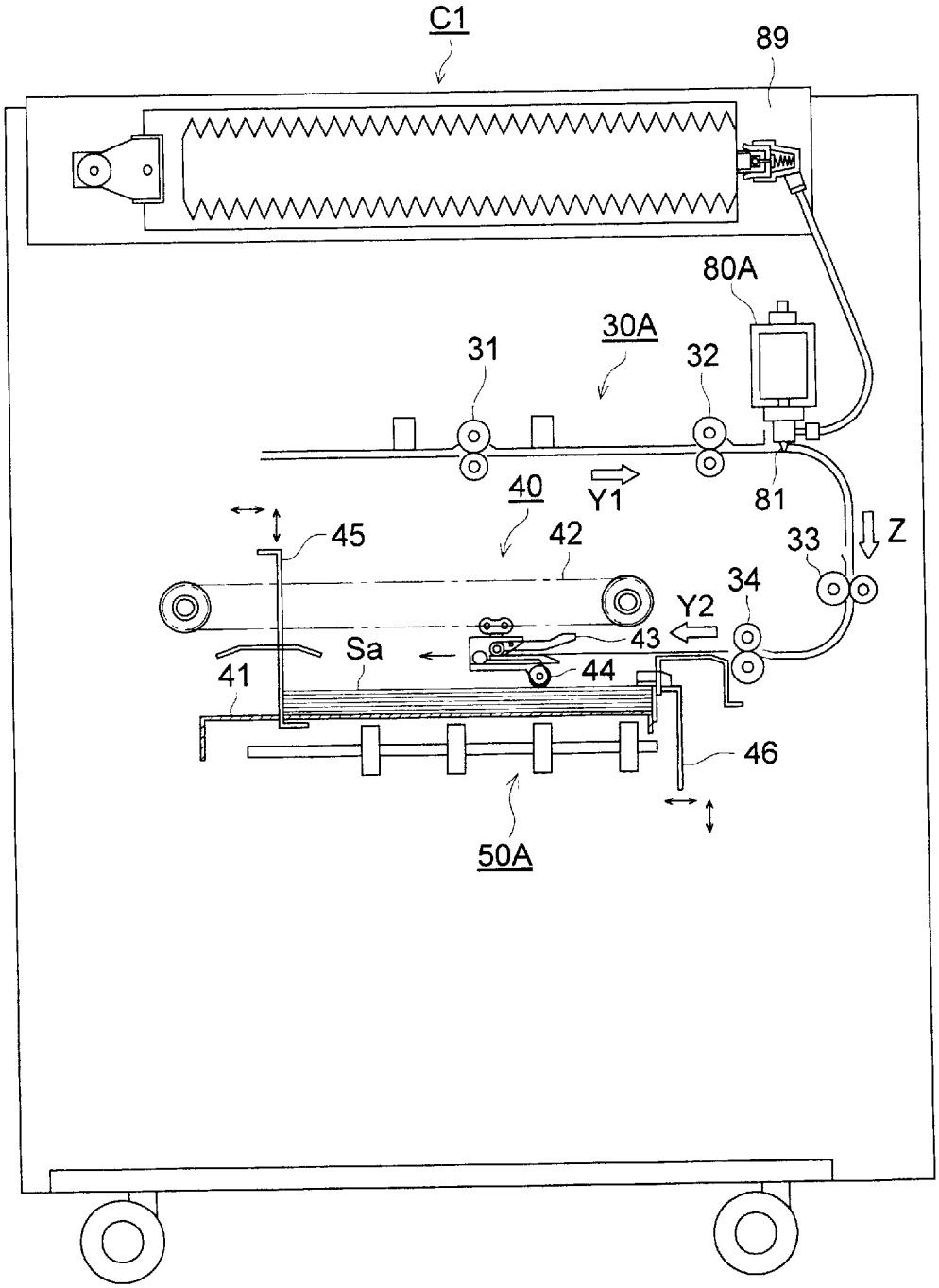
FIG. 26 is a side sectional view of the first pasting and bookbinding apparatus.
Figure 27:
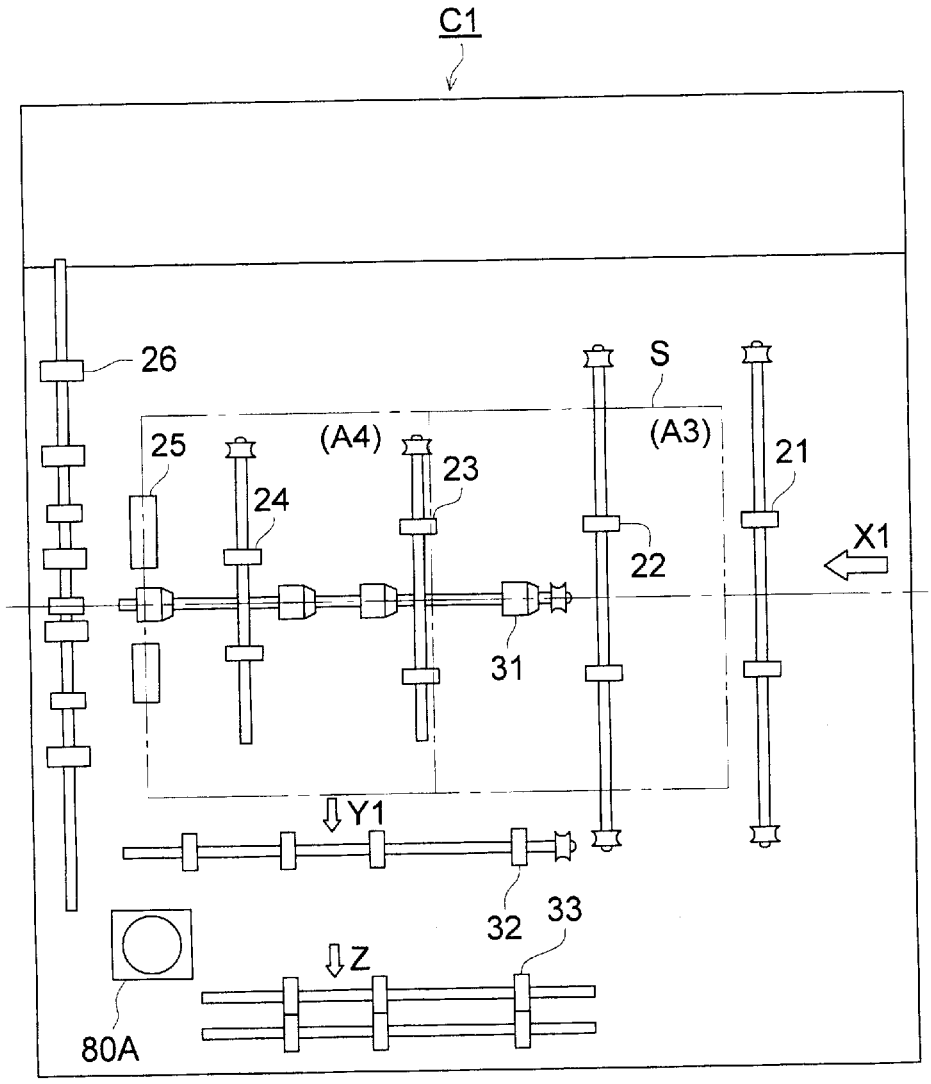
FIG. 27 is a plan view of the first pasting and bookbinding apparatus.
Figure 28:
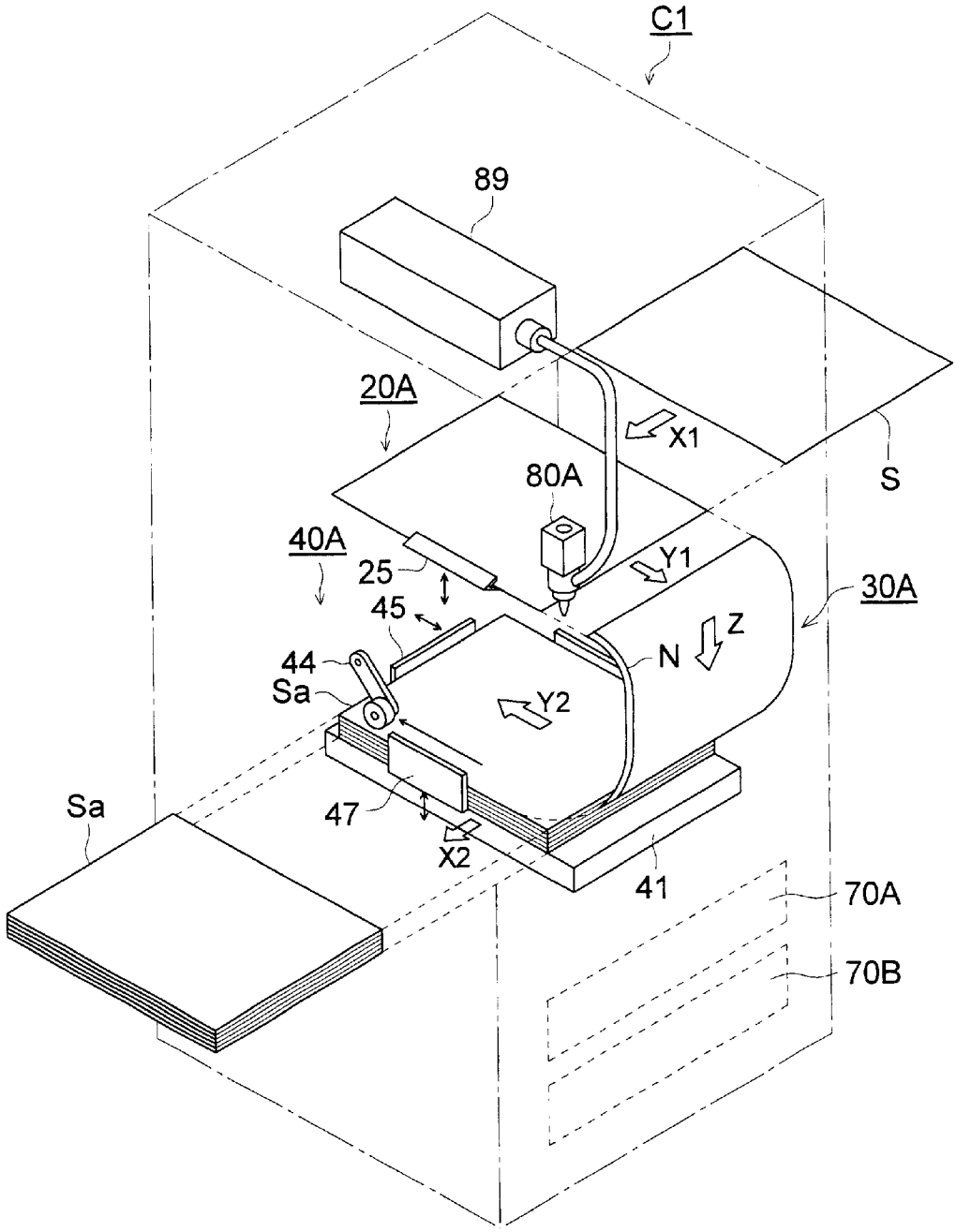
FIG. 28 is a typical perspective view for explaining a sheet conveying path at the time of paste coating processing and the paste coating processing.

FIG. 26 is a side sectional view of a pasting and bookbinding apparatus C1, FIG. 27 is a plan view, and FIG. 28 is a typical perspective view for explaining the sheet conveying path at the time of the paste coating processing and the paste coating processing.

Figure 29:
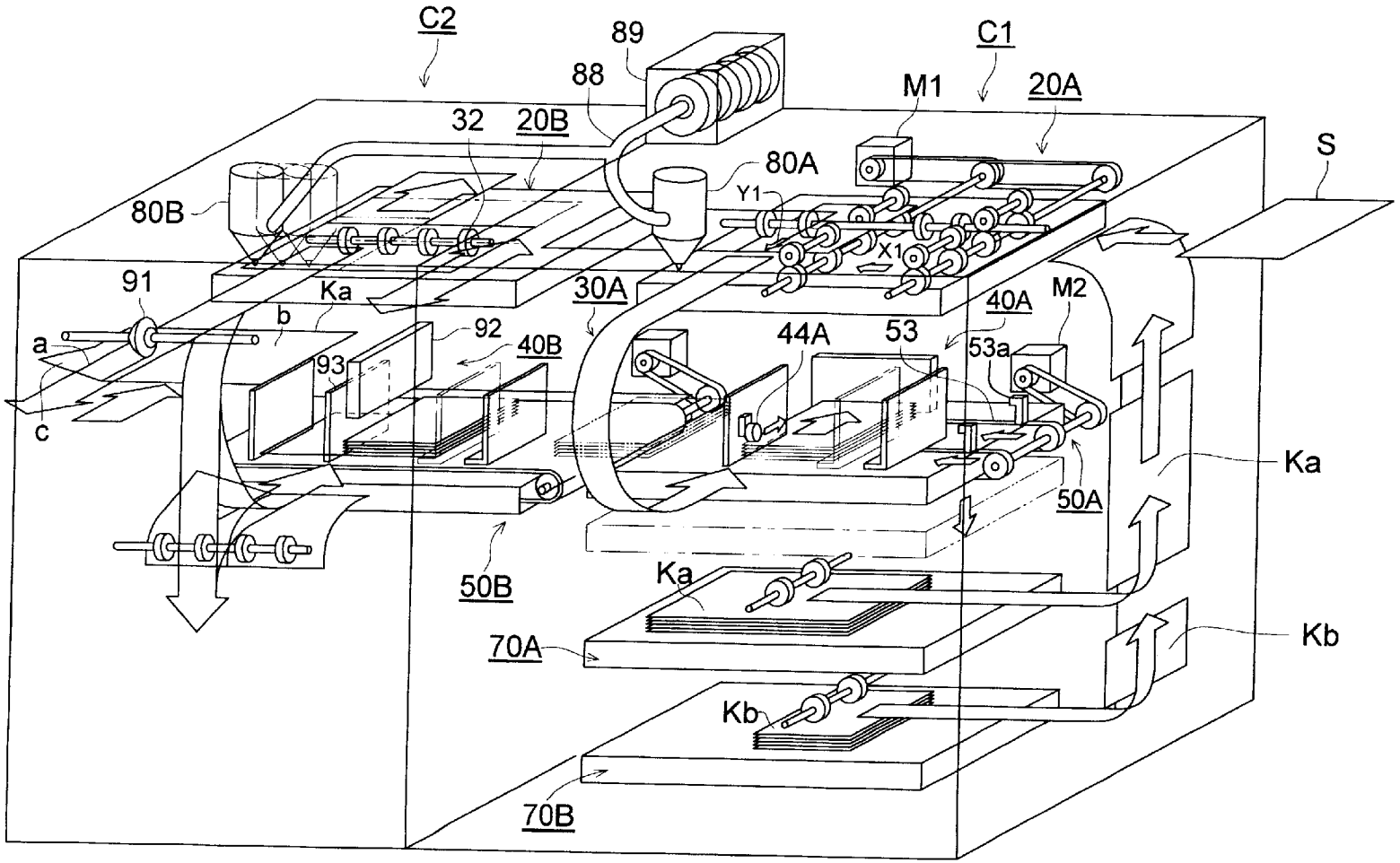
FIG. 29 is a typical perspective view for explaining a sheet conveying path at the time of paste coating processing in the first pasting and bookbinding apparatus and the second pasting and bookbinding apparatus and the paste coating processing.

Orthogonal U-turn conveyance of the sheet by the direction change conveying means 30A:

When the apparatus is set to the pasting and bookbinding processing mode, the sheet S delivered from the image forming apparatus main body A is held by the conveying rollers 21–24 rotated by a motor M1 shown in FIG. 29 and conveyed. When the leading edge portion of the sheet S comes into contact with the positioning member 25, the skew of the sheet S is corrected, and the positioning of the conveyance direction is conducted (the first conveying path X1 in the arrowed direction in FIGS. 25, 27, 28). After that, the drive of the motor M1 is stopped, and each of upper rollers of the conveying rollers 21–24 is withdrawn from the sheet surface to the upward by a drive means, not shown, and the pressure contact is released.

Further, the sheet S is held by the conveying rollers 31 and 32 rotated by a drive means, not shown, and conveyed to the conveying direction deflected by 90° (the second conveying path Y1 in the arrowed direction in FIGS. 26–28). Successively, the sheet S is held by the conveying roller 33 and 34 and U-turn-conveyed and sent to a sheet accommodation section 40A (the third conveying path Z in the arrowed direction in FIGS. 26–28).

(Adhesion of the Cover Sheet)

When the same side cover sheet (front cover or back cover) as the sheet set Sa is adhered onto the sheet set Sa, the cover sheet is supplied from the first sheet feed means 70A arranged below the first pasting and bookbinding apparatus C1 or the second sheet feed means 70B. The cover sheet accommodated in the sheet feed cassette 71A of the first sheet feed means 70A or the sheet feed cassette 71B of the second sheet feed means 70B is supplied from the sheet feed section 72A or sheet feed section 72B, passes the conveying rollers 73, 74, and after it is conveyed to the horizontal conveying means 20A, the paste coating portion N is formed by the first paste jetting means 80A, and via the direction change conveying means 30A, sent to the sheet accommodation section 40A, and adhered onto the uppermost surface of the sheet set Sa (refer to FIG. 25).

The paste used in the embodiment of the present invention is a water emulsion paste, for example, a vinyl acetate resin series emulsion paste, and whose viscosity is 750–1500 Pa·s at normal temperature. The sheet set Sa adhered by this water soluble paste can be recycled as the re-generation paper.

(Stacking, Aligning, and Pressing Processing of the Sheet S) (Refer to FIG. 27)

The first sheet S which is not paste coating-processed is held and conveyed to the fourth conveying path Y2 by the rotated conveying rollers 33, 34, and stacked on the sheet stacking table 41. Following sheets S subsequent to the second sheet, which are paste coating-processed, are held and conveyed to the fourth conveying path Y2 by the conveying rollers 33, 34, and stacked on the preceding sheet S on the sheet stacking table 41.

By the above processes, the paste coating processed one sheet set Sa is completed. In this first pasting and bookbinding apparatus C1, for example, the sheets S of the maximum 200 sheets can be pasting processed and bookbinding processed.

(Sheet Delivery from the First Pasting and Bookbinding Apparatus C1)

On a portion of the sheet stacking surface of the sheet stacking table 41, a plurality of delivery belts 53 wound around the drive roller 51 and the driven roller 52 are rotatably arranged.

A final sheet S is stacked on the sheet stacking table 41, and pressing processed, and a trailing edge portion of a pasted and book-bound sheet set Sa is held by a delivery claw 53*a* of the delivery belt 53 rotated by a motor M2, and slides on the stacking surface of the sheet stacking table 41, and held by the sheet set delivery roller 54 and delivered from the lower portion delivery port 55 to the inlet portion of the second pasting and bookbinding apparatus C2, and introduced (the fifth conveying path X2 in the arrowed direction in FIG. 28). Prior to this delivery sheet processing, the pressing means 44 and width alignment means 47 are withdrawn to the above of the conveying path by a drive means, not shown.

(The Second Pasting and Bookbinding Apparatus C2)

The pasting and bookbinding apparatus of the present invention has the first pasting and bookbinding apparatus (sheet set production apparatus) C1 to conduct the pasting and bookbinding processing on a portion between sheets and produce the sheet set Sa, and the second pasting and bookbinding apparatus (cover bookbinding production apparatus) C2 to adhere the front cover and back cover onto the front and rear surfaces of the sheet set Sa and the back portion and to conduct the pasting and bookbinding processing, and produce the booklet Sb.

Figure 30:
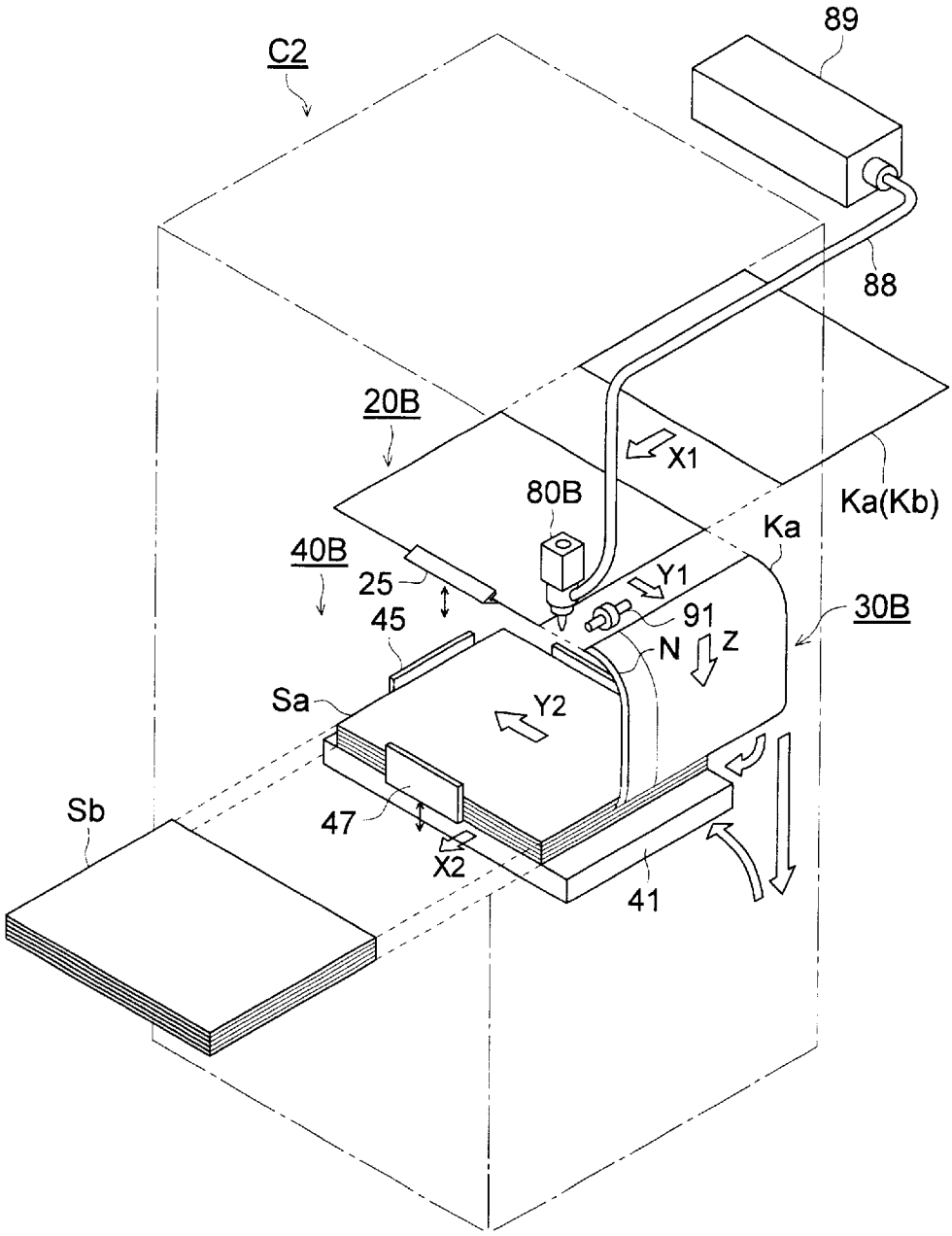
FIG. 30 is typical perspective view showing a sheet conveying path and the paste coating processing of the first paste coating and bookbinding apparatus.
Figure 31:
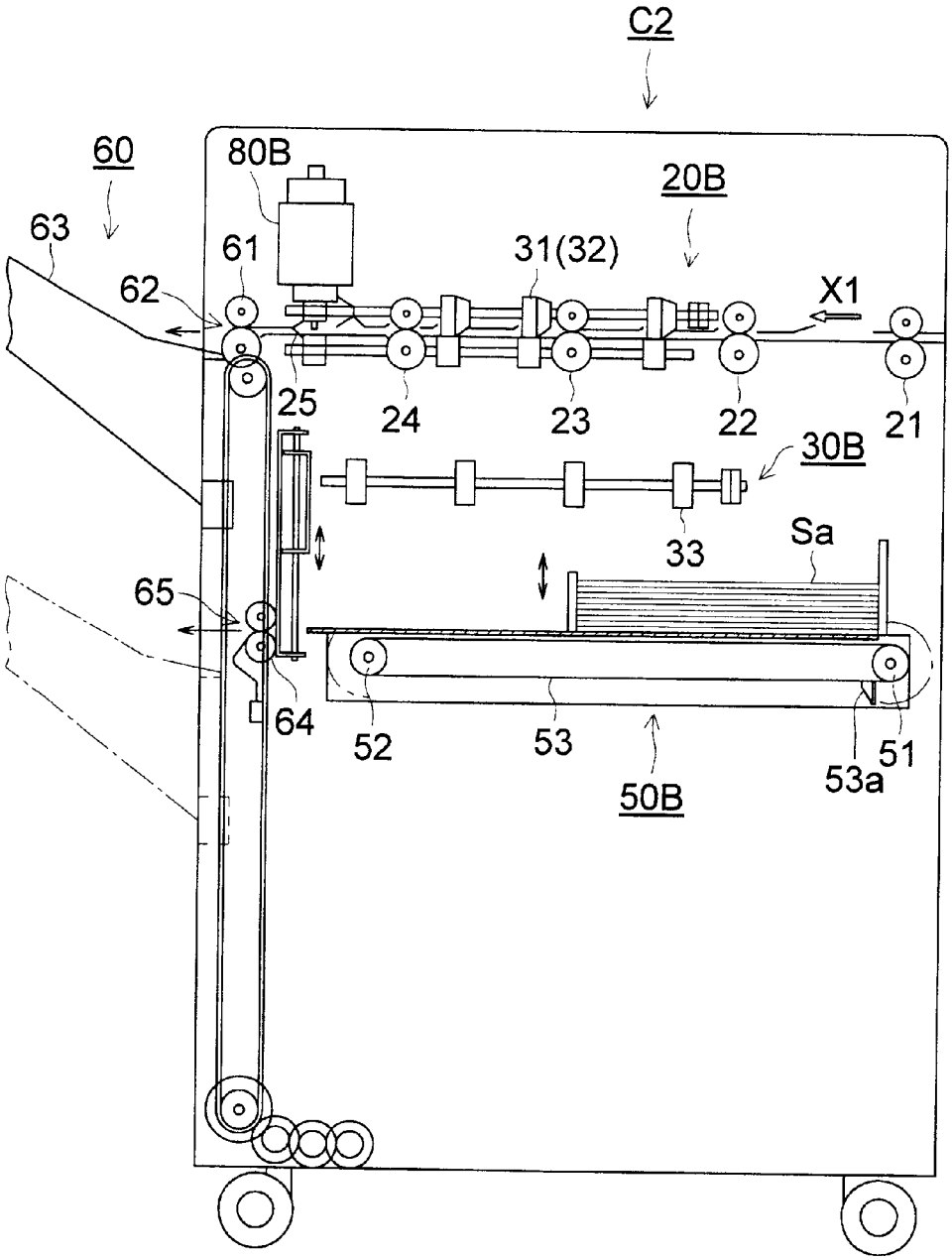
FIG. 31 is an elevational sectional view of the second pasting and bookbinding apparatus.

FIG. 29 is a typical perspective view for explaining the sheet conveying path at the time of the paste coating processing in the first pasting and bookbinding apparatus C1 and the second pasting and bookbinding apparatus C2, and the paste coating processing. FIG. 30 is a typical perspective view showing the sheet conveying path of the second pasting and bookbinding apparatus C2 and the paste coating processing. FIG. 31 is an elevational sectional view of the second pasting and bookbinding apparatus C2.

In these views, because the horizontal conveying means 20B to structure the sheet conveying path of the second pasting and bookbinding apparatus C2, direction change conveying means 30B, sheet accommodation section 40B, and each member to structure the second paste jetting means 80B, are almost the same structure as the horizontal conveying means 20A of the first pasting and bookbinding apparatus C1, direction change conveying means 30A, sheet accommodation section 40A, and each member to structure the first paste jetting means 80A, the member having the same function as the first pasting and bookbinding apparatus C1 is denoted by the same numeral and sign, and the explanation is neglected.

The sheet S on which the pasting and bookbinding processing is not conducted or the sheet S on which the shift processing is conducted, is conveyed by the horizontal conveying means 20A and the horizontal conveying means 20B, and held by the delivery roller 61 and delivered from the upper delivery port 62, and stacked on the up and down sheet delivery tray 63 of the outside of the apparatus (refer to FIG. 25, FIG. 26).

The sheet set Sa produced by the first pasting and bookbinding apparatus C1 is conveyed by the sheet delivery means 50A, and delivered from the lower delivery port 55, and introduced into the second pasting and bookbinding apparatus C2, conveyed from the delivery means 50B, and delivered from the lower delivery port 65, and stacked onto the up and down sheet delivery tray 63 (refer to FIG. 25, FIG. 26).

The mechanism of the cover bookbinding production function is provided with the horizontal conveying means 20B, direction change conveying means 30B, sheet accommodation section 40B, creasing roller 91, the second paste jetting means 80B, and the first sheet feeding means (front cover sheet feeding means) 70A, and the second sheet feeding means (back cover sheet feeding means) 70B.

The creasing roller 91 is provided on the downstream side of the second conveying path Y1, and creases the first fold a on the conveying front cover Ka, and folds it to a loose V character shape, and forms the cover surface portion b of the same size as the sheet S and the back cover portion c.

The first sheet feeding means 70A of the upper stage shown in FIG. 25 is structured by a sheet feed cassette 71A to accommodate the front cover Ka and sheet feeding section 72A. A sheet of front cover Ka fed from the sheet feeding cassette 71A by the sheet feeding section 72A is held by the conveying rollers 73 and 74 and elevated, and passes through the horizontal conveying means 20A of the first pasting and bookbinding apparatus C1 and through the horizontal conveying means 20B of the second pasting and bookbinding apparatus C2, and direction change conveying means 30B, the first fold a is creased by the creasing roller 91 and the cover Ka is sent into the sheet accommodation section 40B.

The second sheet feeding means 70B of the lower stage shown in FIG. 25 is structured by a sheet feed cassette 71B to accommodate the back cover Kb and sheet feeding section 72B. A sheet of back cover Kb fed from the sheet feeding cassette 71B by the sheet feeding section 72B is held by the conveying rollers 73 and 74 and elevated, and passes the horizontal conveying means 20A of the first pasting and bookbinding apparatus C1, and is sent into the horizontal conveying means 20B of the second pasting and bookbinding apparatus C2, and through the direction change conveying means 30B, the cover Kb is sent into the sheet accommodation section 40, and superimposed on the upper surface of the sheet set Sa, and the pasting and bookbinding is conducted thereon.

(Cover Bookbinding Production Process)

FIGS. 32(*a*)–32(*h*) are perspective views showing the process by which the front cover Ka and the back cover Kb are pasted onto the sheet set sa and the cover bookbinding is conducted thereon, and FIG. 33 to FIG. 39 are perspective views showing the detail of the pasting and cover bookbinding production process by the pasting and bookbinding apparatus. The pasting and cover bookbinding production process will be described below.

Figure 33:
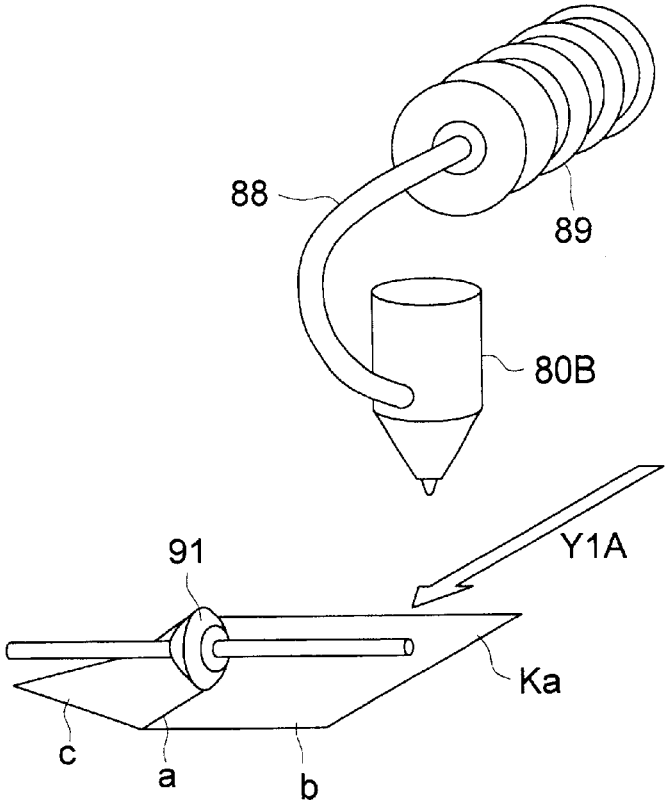
FIG. 33 is a perspective view showing a detail of pasting and cover bookbinding production process by a pasting and bookbinding apparatus.

(1) In the front cover Ka conveyed in the void arrowed Y1A direction of the second conveying path Y1 by the conveying roller 32, the first fold a is creased by a pair of the creasing roller 91 and folded into a loose V character shape, and the cover surface portion b of the same size as the sheet S and back cover portion c are formed (refer to FIG. 33, FIG. 32(*a*)).

(2) The conveying rollers 31 and 32 of the direction change conveying means 30B are reversely rotated, and the front cover Ka is reversal-conveyed in the void arrowed Y1B direction of the upstream direction of the second conveying path Y1. While the front cover Ka is conveyed in the Y1B direction, the paste is jetted from the second paste jetting means 80B, and one linear paste coating portion Na is formed in the vicinity of the first fold a on the surface of the back cover portion c of the front cover Ka (refer to FIG. 34(*a*)).

Next, after the second paste jetting means 80B is moved to the direction perpendicular to the Y1B direction, the conveying rollers 31, 32 are switched to the normal rotation, and the front cover Ka is conveyed to the Y1A direction. While the front cover Ka is conveyed to the Y1A direction, the paste jetted from the second paste jetting means 80B forms the second linear paste coating portion Nb adjoining the paste coating portion Na on the front cover Ka (refer to FIG. 34(*b*)).

In succession, after the second paste jetting means 80B is moved to the direction perpendicular to the Y1A direction, the conveying rollers 31, 32 are switched to the reversal rotation, and the front cover Ka is conveyed to the Y1B direction. While the front cover Ka is conveyed to the Y1B direction, the paste jetted from the second paste jetting means 80B forms the third linear paste coating portion Nc adjoining the paste coating portion Nb on the front cover Ka (refer to FIG. 34(*c*)).

In this manner, on the surface of the back cover portion c of the front cover Ka, in the vicinity of the fist fold a, the wide paste coating portion N5 formed of three paste coating portions Na, Nb, and Nc is formed (refer to FIG. 32 (*b*)). The width of the paste coating portion N5 is set by the number of linear paste coating portions (Na-Nc) so that it is wider than the width of the back portion of the sheet set Sa on which the pasting and bookbinding processed.

Figure 35:
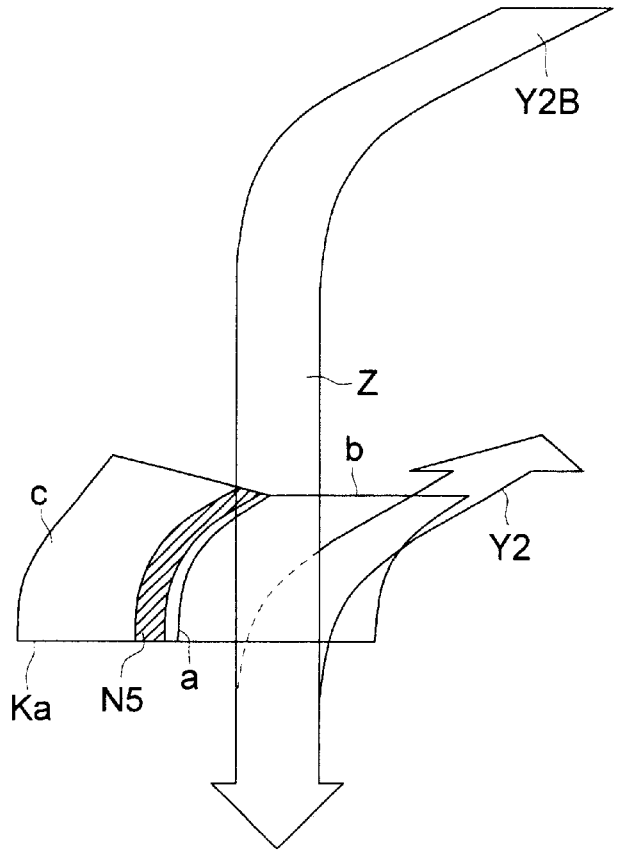
FIG. 35 is a perspective view showing a detail of pasting and cover bookbinding production process by a pasting and bookbinding apparatus.

The front cover Ka which is folded and which has the wide paste coating portion N5 is held by the conveying roller of the direction change conveying means 30B, and after it is conveyed lower once in the third conveying path Z, it is switch backed and conveyed upward, and conveyed to the fourth conveying path Y2 direction, stacked on the sheet stacking table 41 of the sheet accommodation section 40B with the back cover portion c facing upward, and the width direction is regulated by the sheet alignment pressing means 46, and comes into contact with the leading edge stopper 45 and stopped (refer to FIG. 35).

Because the sheet accommodation section 40A of the first pasting and bookbinding apparatus C1 becomes vacant after the preceding sheet set Sa is moved to the second pasting and bookbinding apparatus C2, the sheet S delivered from the image forming apparatus main body A can be successively stacked on the sheet accommodation section 40A.

(3) After the front cover Ka is conveyed onto the sheet stacking table 41 and stacked at a predetermined position, the sheet set Sa which is pasting and bookbinding processed by the first pasting and bookbinding apparatus C1 is introduced into the second pasting and bookbinding apparatus C2, and conveyed onto the upper surface of the front cover Ka on the sheet accommodation section 40B, and positioned by the sheet alignment pressing means 46.

Next, the first creasing means 93 supported at the withdrawn position below the sheet stacking table 41 is elevated, and the back cover portion c of the front cover Ka is pressed and the loosely folded back cover portion c is folded at almost right angle along the first fold a, and the wide paste coating portion N5 formed on the surface of the back cover portion c of the front cover Ka, and the back portion of the sheet set Sa are adhered (refer to FIG. 36(*a*), FIG. 32(*c*)).

(4) After the right angle folding of the front cover Ka, the second creasing means 94 is advanced in the horizontal direction by the drive means, and forms the second fold d on the front cover Ka and folds it at the right angle, and forms the fold back portion (refer to FIG. 36(*b*), FIG. 32(*d*))

Figure 37:
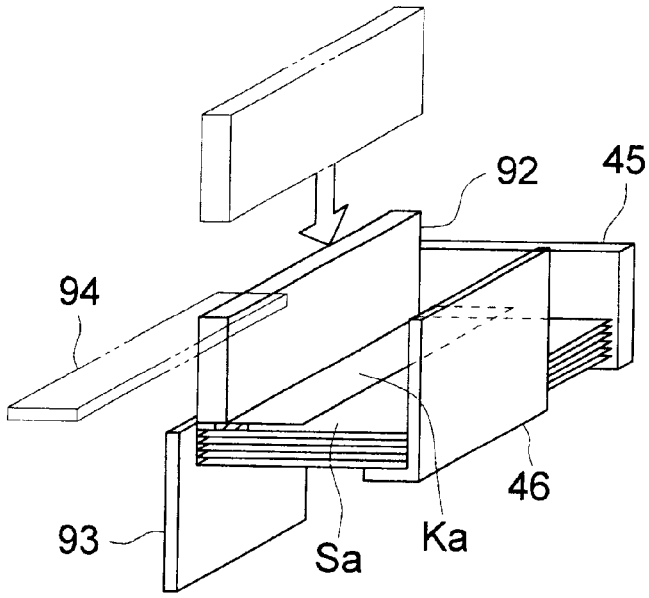
FIGS. 37(*a*)–37(*b*) are perspective views showing a detail of pasting and cover bookbinding production process by a pasting and bookbinding apparatus.
Figure 37:
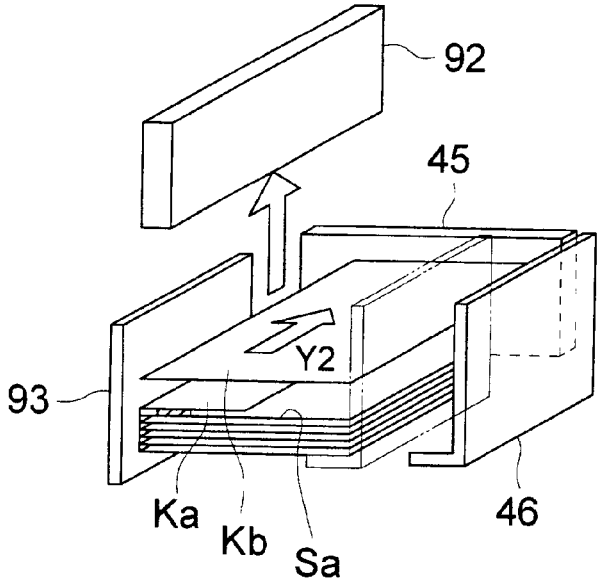

(5) The second creasing means 94 goes back and is withdrawn to the initial position, and the cover pressing member 92 is lowered, and presses the upper surface side of the fold back portion of the front cover Ka, and adheres the fold back portion onto the final sheet Sn of the sheet set Sa (refer to FIGS. 37(*a*), 32(*e*)).

(6) The cover pressing member 92 is elevated and withdrawn upward. On the one hand, the rear cover Kb set out by the second sheet fed means 70B is sent onto the sheet stacking table 41 with the paste coating portion N facing downward, through the conveyance in the X1 direction by the horizontal conveying means 20A, 20B, and the conveyance in Y1 direction, Z direction, and Y2 direction by the direction change conveying means 30B.

Figure 40:
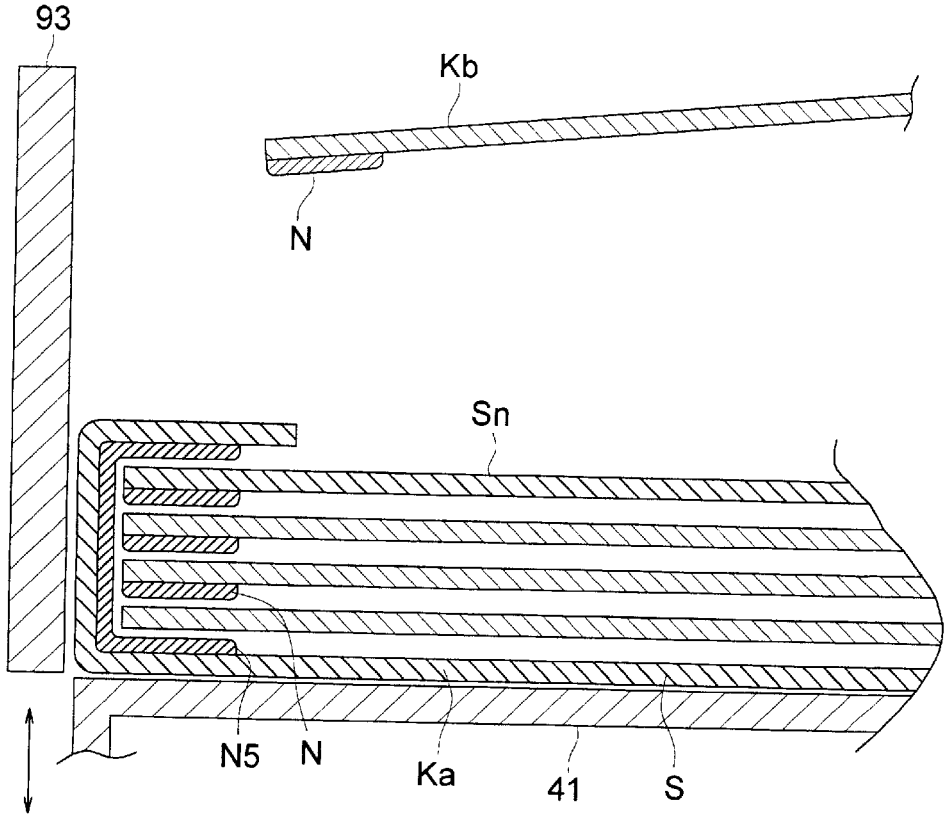
FIG. 40 is a partially enlarged sectional view of the sheet set stacked on the sheet stacking table.

FIG. 40 is a partial enlarged sectional view of the sheet set Sa stacked on the sheet stacking table 41. The sheet S of the second and subsequent sheet forming the paste coating portion N is stacked on the preceding sheet S, and a portion between sheets is adhered, and the back portion of the front cover Ka and the back portion of each of sheets S are adhered by the wide paste coating portion N5.

The side edge portion of the rear cover Kb in which the paste coating portion N is formed, and which is sent onto the sheet stacking table 41 is pressed by the sheet alignment pressing means 46 and its width is aligned, and it is stacked on the uppermost layer of the sheet set Sa and the fold back portion of the front cover Ka and adhered onto the back portion of the front cover Ka (refer to FIG. 37(*a*), FIG. 32(*f*), FIGS. 36(*a*)–36(*b*)).

Figure 38:
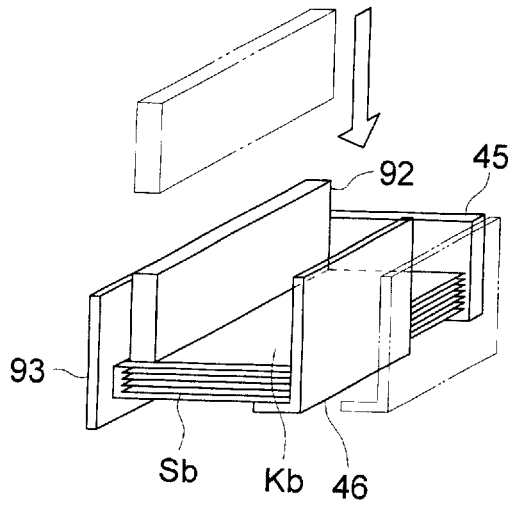
FIG. 38 is a perspective view showing a detail of pasting and cover bookbinding production process by a pasting and bookbinding apparatus.
Figure 39:
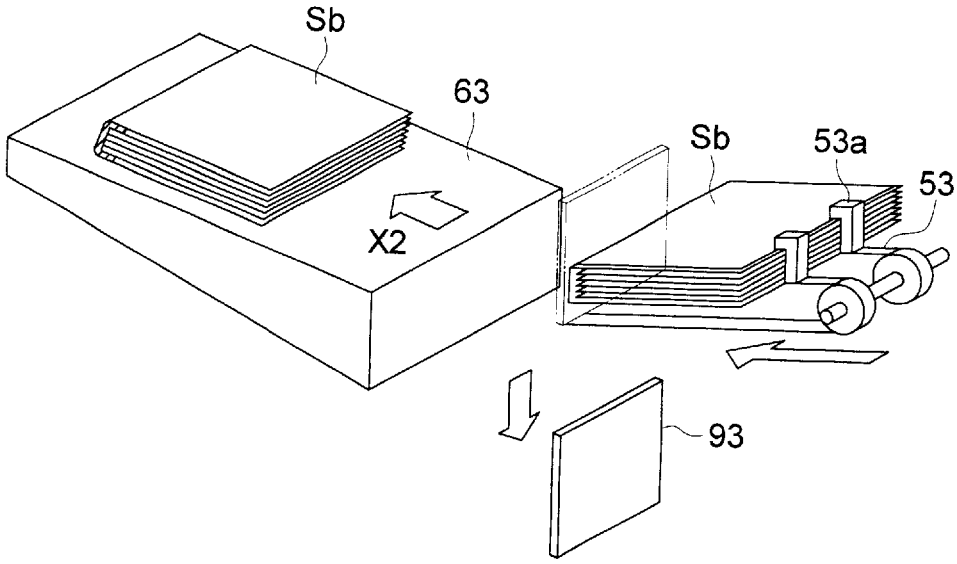
FIG. 39 is a perspective view showing a detail of pasting and cover bookbinding production process by a pasting and bookbinding apparatus.

(7) The upper surface side of the adhered surface of the fold back portion of the front cover Ka to the rear cover Kb is pressed by the cover pressing member 92 and the adhesion is strengthened (refer to FIG. 38, FIG. 32(*g*)).

(8) The first creasing means is lowered, and withdrawn at the initial position below. The trailing edge portion of the pasting and bookbinding proceed booklet Sb is held by the delivery claw 53*a* of the rotating delivery belt 53, and delivered onto the up and down sheet delivery tray 63, and stacked (the fifth conveying path X2 in the arrowed direction). (Refer to FIG. 39, FIG. 32(*h*)).

On the up and down sheet delivery tray 63, the sheet S which is not paste coating processed, and held by the delivery roller 61 and delivered from the upper delivery port 62, and sheet set Sa which is paste coating processed, and held by the delivery roller 64 and delivered from the lower delivery port 65, and cover bookbinding processed booklet Sb can be stacked, and by the up and down drive, a large amount of sheet S, sheet set Sa, and booklet Sb can be accommodated.

In this connection, the pasting and bookbinding apparatus composed of the first pasting and bookbinding apparatus C1 and the second pasting and bookbinding apparatus C2 of the present invention may be formed into the independent apparatus, and the pasting and bookbinding can also be conducted on the sheet processed by the other image forming apparatus.

As can clearly be seen from the above description, the following effects can be obtained by the pasting and bookbinding apparatus, pasting and bookbinding method, and image forming apparatus of the present invention.

(1) The pasting and bookbinding apparatus and pasting and bookbinding method of the present invention is, when the sheet set production apparatus by which a portion between sheets delivered from the image forming apparatus main body is adhered and the booklet is formed, and the cover bookbinding apparatus by which the front cover and rear cover are adhered onto the sheet set produced by the sheet set production apparatus, and the booklet is produced, are formed into a pasting and bookbinding apparatus structured by connecting them as a separated apparatus, the cover bookbinding apparatus can parallel conduct a process to produce the booklet by adhering the front cover and rear cover and sheet set onto the preceding sheet set, and a process for the sheet set production apparatus to produce the booklet when the succeeding sheet delivered from the image forming apparatus main body, is accommodated and conducted by alignment, adhering, and pressing processing. When these both processes are parallel conducted, the time margin is produced in the time of cover bookbinding process, and the high quality and sure cover bookbinding can be conducted.

(2) By the image forming apparatus provided with the pasting and bookbinding apparatus of the present invention, for the sheet delivered at the high speed from the image forming apparatus main body, without lowering the high sped productivity of the image forming apparatus main body, the high quality and sure cover bookbinding can be continuously produced by the pasting and bookbinding apparatus composed of the sheet set production apparatus and cover bookbinding production apparatus.

What is claimed is:

1. A pasting and bookbinding method comprising the steps of:

a) correcting a sheet skew by bringing a leading edge of a sheet conveyed in a first conveying path having a sheet conveyor into contact with a hitting member;

(b) forming a linear paste coating portion by a paste jetting device in the vicinity of a side edge portion of the sheet while being conveyed in a second conveying path arranged in a direction perpendicular to a first conveying path;

(c) stacking each of the plurality of sheets constituting a sheet set after forming thereon the linear paste coating portion on a sheet stacking table provided below the second conveying path;

(d) aligning the sheets by an aligning device;

(e) pressing the linear pasted portion between adjacent sheets by a pressing device to adhere the sheets together, thereby producing a booklet;

(f) delivering the booklet by a delivery device so that the booklet is delivered onto a delivery tray provided in a pasting and bookbinding apparatus;

(g) after the step of the pressing, covering and adhering a side edge portion on a front cover surface side, a side edge portion on a back cover surface side and a backbone portion of the booklet with a front cover, wherein the front cover has a dimension to cover the front cover surface side and the backbone portion and a portion of the back cover surface side of the sheet set;

(h) then adhering a back cover to the front cover on the back cover surface side of the sheet set, the back cover having a same size as the sheet set; and (i) pressing the back cover and the front cover while interposing the pasted booklet therebetween.

2. A pasting and bookbinding method comprising the steps of:

(a) correcting a sheet skew by bringing a leading edge of a sheet conveyed in a first conveying path having a sheet conveyor into contact with a hitting member;

(b) forming a linear paste coating portion by a paste jetting device in the vicinity of a side edge portion of the sheet while being conveyed in a second conveying path arranged in a direction perpendicular to a first conveying path;

(c) stacking each of the plurality of sheets constituting a sheet set after forming thereon the linear paste coating portion on a sheet stacking table provided below the second conveying path;

(d) aligning the sheets by an aligning device;

(e) pressing the linear pasted portion between adjacent sheets by a pressing device to adhere the sheets together, thereby producing a booklet;

(f) delivering the booklet by a delivery device so that the booklet is delivered onto a delivery tray provided in a pasting and bookbinding apparatus;

(g) feeding a front cover from a front cover feeder;

(h) forming a paste coating portion at a predetermined area of the front cover by a second paste jetting device;

(i) stacking the front cover at a predetermined position on the sheet stacking table by a conveyor;

(j) conveying the booklet delivered from the delivery device to the front cover stacked on the sheet stacking table;

(k) adhering a paste coating portion of the front cover and a front surface side of the booklet together;

(l) then, forming a first crease on the front cover;

(m) adhering a backbone portion of the booklet and the paste coating portion of the front cover in accordance with the backbone portion;

(n) further, forming a second crease on the front cover along an upper surface of the booklet;

(o) adhering a side edge portion of the upper surface of the booklet and the paste coating portion of the front cover in accordance with the side edge portion of the upper surface of the booklet;

(p) thereafter, forming a linear paste coating portion on a back cover which has been fed by a back cover feeder, by the second paste jetting device;

(q) conveying the back cover to an upper surface of the front cover which has been tuned up along the first crease, then placing thereon;

(r) adhering the back cover and the front cover together; and (s) then, pressing the paste coating portions of the front cover, the booklet and the back cover.

3. A pasting and bookbinding apparatus comprising:

(a) a first conveying path in which a sheet is positioned through correcting a sheet skew by bringing a leading edge of the sheet conveyed from an outside of the apparatus into contact with a hitting member;

(b) a second conveying path in which the sheet is conveyed in a direction perpendicular to the first conveying path;

(c) a paste jetting device provided on the second conveying path for forming a paste coating portion in the vicinity of a side edge portion of the sheet;

(d) a third conveying path in which the sheet is reversed and conveyed after the paste coating portion is formed;

(e) a fourth conveying path provided below the second conveying path in which the sheet is stacked onto a sheet stacking table;

(f) an aligner for aligning a plurality of sheets;

(g) a pressing device for pressing the pasted portion between adjacent sheets to adhere the sheets together, thereby producing a booklet;

(h) a delivery device for delivering the booklet;

(i) a delivery tray provided in the apparatus, for accommodating the delivered booklet;

(j) a cover conveyor for conveying a cover to the sheet stacking table where the cover is aligned by the aligner;

(k) a first folding device for folding the cover substantially at a right angle, wherein each of a plurality of sheets constituting a sheet set has a paste coating portion formed by the paste jetting device and then is stacked successively onto the sheet stacking table; and (l) a second folding device for turning up the cover and covering a backbone portion of the plurality of sheets constituting a sheet set, thereby the cover and the sheet set are adhered together and a booklet is produced.

4. The pasting and bookbinding apparatus of claim 3, further comprising a conveyance channel branched from the first conveying path, wherein a sheet delivered from outside the apparatus is introduced, conveyed, delivered from a delivering port and stacked onto an exit tray.

5. The pasting and bookbinding apparatus of claim 3, wherein the cover for covering the sheet set is consisted of a front cover for adhering a front cover surface side of the sheet set and a back cover for adhering a back cover surface side of the sheet set.

6. The pasting and bookbinding apparatus of claim 3, wherein a front cover has a dimension to cover a front cover surface side and the backbone portion and a portion of a back cover surface side of the sheet set, and a back cover has a same size as the sheet set.

7. The pasting and bookbinding apparatus of claim 3, wherein each sheet of the sheet set is stacked on the sheet stacking table with the linear paste coating portion facing downward, and a last sheet of the sheet set is stacked on the stacking table with the linear paste coating portion formed on both sides thereof.

8. The pasting and bookbinding apparatus of claim 3, wherein paste for adhering adjacent sheets of the sheet set, a front cover and a back cover is a water-soluble paste of vinyl acetate resin emulsion type.

9. An image forming apparatus comprising:

(a) an image forming apparatus main body comprising an image writing device, an image forming device, and a sheet conveyor; and (b) the pasting and bookbinding apparatus of claim 3.

10. A pasting and bookbinding apparatus comprising:

(a) a first conveying path in which a sheet is positioned through correcting a sheet skew by bringing a leading edge of the sheet conveyed from an outside of the apparatus into contact with a hitting member;

(b) a second conveying path in which the sheet is conveyed in a direction perpendicular to the first conveying path;

(c) a paste jetting device provided on the second conveying path for forming a paste coating portion in the vicinity of a side edge portion of the sheet;

(d) a third conveying path in which the sheet is reversed and conveyed after the paste coating portion is formed;

(e) a fourth conveying path provided below the second conveying path in which the sheet is stacked onto a sheet stacking table;

(f) an aligner for aligning a plurality of sheets;

(g) a pressing device for pressing the pasted portion between adjacent sheets to adhere the sheets together, thereby producing a booklet;

(h) a delivery device for delivering the booklet;

(i) a delivery tray provided in the apparatus, for accommodating the delivered booklet;

(j) a bookbinding device is connected to the delivery device for delivering the booklet, receives the booklet delivered from the delivery device, and covers a side edge portion of a front cover surface side, a side edge portion of a back cover surface side and a backbone portion of the booklet, by a front cover on which a paste coating portion has been formed, thereby adhering the front cover to the booklet.

11. The pasting and bookbinding apparatus of claim 10, wherein the front cover having a dimension to cover a front cover surface side and the backbone portion and a portion of a back cover surface side of the sheet set, and a back cover having a same size as the sheet set are made to cover and adhere to the sheet set.

12. The pasting and bookbinding apparatus of claim 10, wherein the bookbinding device comprising:

a second paste jetting device for forming paste coating portions on a front cover and a back cover;

a conveyor for conveying the front cover and the back cover;

an aligning device for accepting the booklet delivered from the delivery device and aligning the front cover and the back cover;

a folding device for folding the front cover on which a paste coating portion has been formed by the second paste jetting device, and covering the backbone portion of the booklet; and a pressing device for adhering the back cover to the front cover and then pressing the back cover.

13. The pasting and bookbinding apparatus of claim 10, wherein the second paste jetting device of the bookbinding device forms a paste coating portion on a rear side part of the back cover, that comes into contact with the side edge portion of the front cover surface side, the side edge portion of the back cover surface side and the backbone portion of the booklet.

14. The pasting and bookbinding apparatus of claim 3, wherein a first sheet among the sheet set is stacked on the sheet stacking table without a paste coating processing, a second sheet and thereafter are stacked with the linear paste coating portion facing downward, and then adhered.

15. The pasting and bookbinding apparatus of claim 10, wherein paste for adhering adjacent sheets of the sheet set, a front cover and a back cover is a water-soluble emulsion paste.

16. The pasting and bookbinding apparatus of claim 10, wherein the bookbinding device makes the second paste jetting device to jet paste while making the front cover to move in a sheet conveyance direction and the second paste jetting device to move in a direction perpendicular to the sheet conveyance direction, so that a plural numbers of linear paste coating portions are formed on a part of the rear part of the front cover which adheres to the backbone portion of the booklet.

17. An image forming apparatus comprising:

(a) an image forming apparatus main body comprising an image writing device, an image forming device, and a sheet conveying device; and (b) a pasting and bookbinding apparatus of claim 10.

* * * * *